US010850542B2

(12) United States Patent
Kanda et al.

(10) Patent No.: US 10,850,542 B2
(45) **Date of Patent: *Dec. 1, 2020**

(54) PRINTING APPARATUS HAVING LOCKING MEMBER MOVABLE WITH COVER

(71) Applicant: Brother Kogyo Kabushiki Kaisha, Nagoya (JP)

(72) Inventors: Ryuichi Kanda, Nagoya (JP); Takehiko Inaba, Chita-gun (JP); Yuki Nagashima, Toyokawa (JP); Atsuo Hirose, Nagoya (JP); Hitoshi Sanada, Nagoya (JP); Yusuke Ikemoto, Nagoya (JP); Sho Asai, Ama (JP); Shotaro Watanabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/367,841

(22) Filed: Mar. 28, 2019

(65) Prior Publication Data

US 2019/0308428 A1 Oct. 10, 2019

(30) Foreign Application Priority Data

Apr. 6, 2018 (JP) ..... 2018-073910

(51) Int. Cl.
*B41J 29/02* (2006.01)

(52) U.S. Cl.
CPC ..... *B41J 29/02* (2013.01)

(58) Field of Classification Search
CPC . B41J 29/02; B41J 15/042; B41J 29/13; B41J 3/4075; B41J 29/58; B41J 29/54;
(Continued)

(56) References Cited

U.S. PATENT DOCUMENTS 10,377,156 B2 * 8/2019 Ikemoto ..... B41J 15/042
2006/0216098 A1 9/2006 Lyman
(Continued)

FOREIGN PATENT DOCUMENTS

JP 2009-173353 A 8/2009
JP 2013-154580 A 8/2013
(Continued)

OTHER PUBLICATIONS

Apr. 19, 2019—U.S. Notice of Allowance—U.S. Appl. No. 15/940,130.

*Primary Examiner* — Henok D Legesse
(74) *Attorney, Agent, or Firm* — Banner & Witcoff, Ltd.

(57) ABSTRACT

A printing apparatus having a body, a cover, a pair of supporting parts, a locking member, and an engaging portion, is provided. At least one of the pair of supporting parts is a movable supporting part. The locking member arranged on the movable supporting part is movable between a locked position and an unlocked position. The engaging portion arranged in a container compartment engageable with the locking member being at the locked position. The locking member at the unlocked position when the cover is open is separated from the engaging portion. In a process where the cover is moved to be closed, a protrusive portion in the cover contacts to be pressed against a contact portion in the locking member, causing the locking member to shift from the unlocked position to the locked position to be engaged with the engaging portion.

9 Claims, 14 Drawing Sheets

(58) Field of Classification Search
CPC ... B41J 29/00; B41J 15/16; B41J 15/04; B41J 13/24; B41J 11/00; B41J 2/01
See application file for complete search history.

(56) References Cited

U.S. PATENT DOCUMENTS

| | | | |
|---|---|---|---|
| 2015/0225198 | A1 | 8/2015 | Sakaino et al. |
| 2018/0297380 | A1 | 10/2018 | Ikemoto et al. |

FOREIGN PATENT DOCUMENTS

| | | | |
|---|---|---|---|
| JP | 2015-208978 | A | 11/2015 |
| JP | 2016-068433 | A | 5/2016 |

* cited by examiner

FIG. 3A
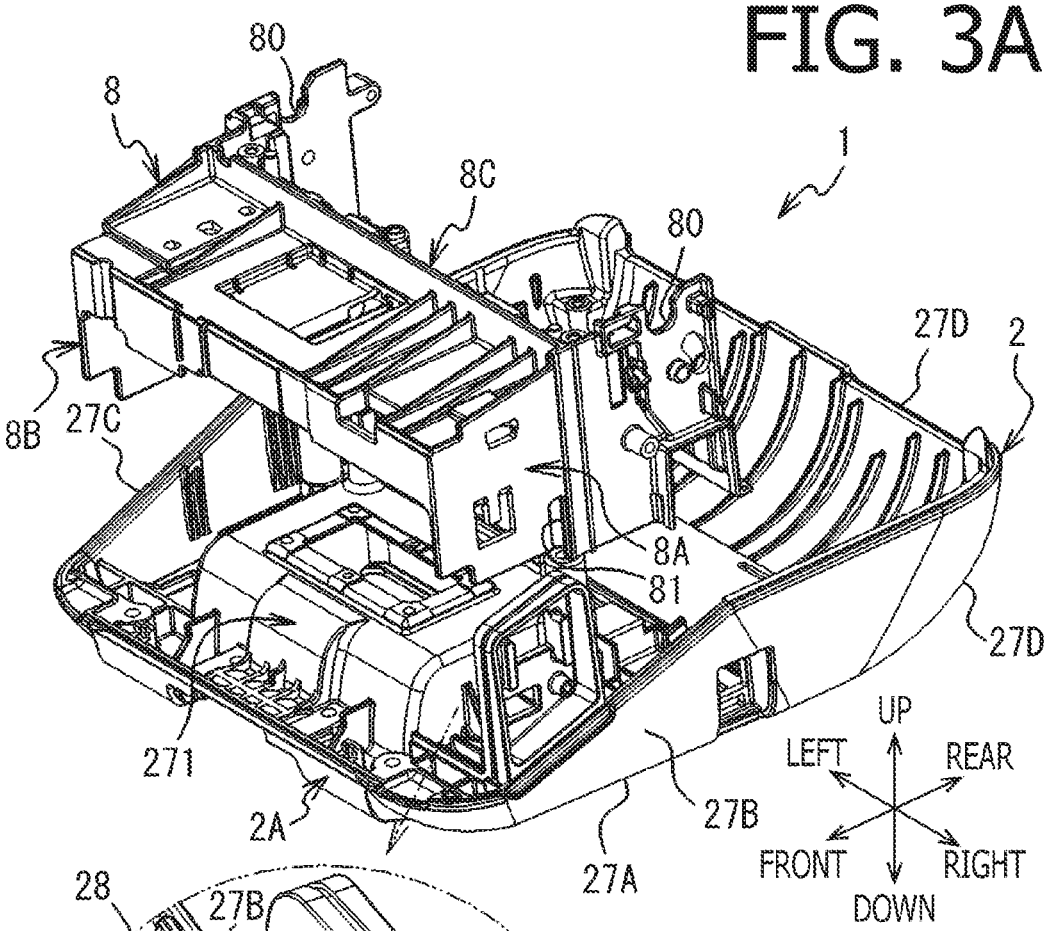
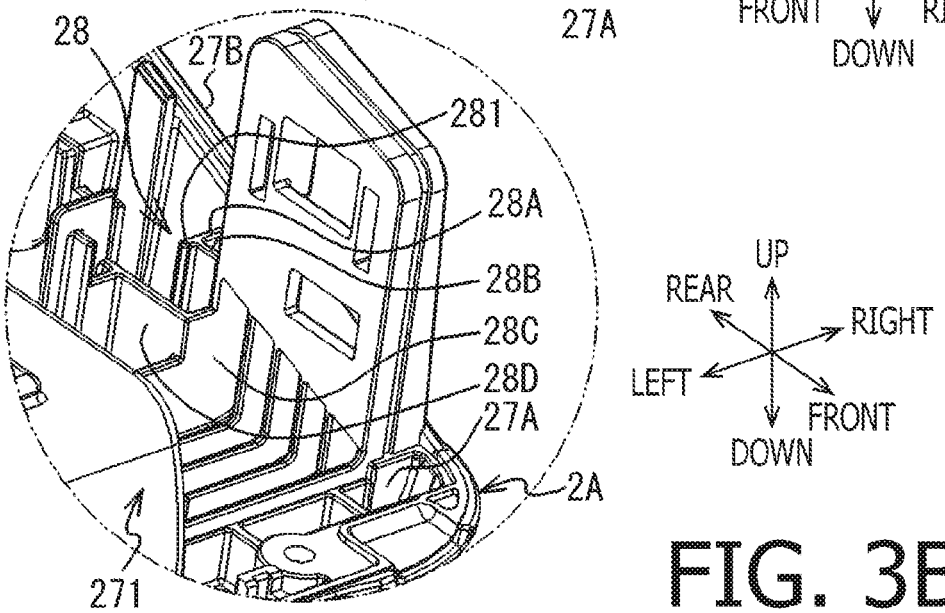
FIG. 3B

PRINTING APPARATUS HAVING LOCKING MEMBER MOVABLE WITH COVER

CROSS REFERENCE TO RELATED APPLICATION

This application claims priority from Japanese Patent Application No. 2018-073910, filed on Apr. 6, 2018, the entire subject matter of which is incorporated herein by reference.

BACKGROUND

Technical Field

An aspect of the present disclosure is related to a printing apparatus.

Related Art

A printing apparatus configured to store a roll of printing medium and print an image on the printing medium while the printing medium is unrolled and conveyed, is known. For example, a label printer being such a printing apparatus may be equipped with a pair of guides and a guide-locking assembly. The paired guides may regulate a widthwise position of the printing medium within the label printer. The paired guides may move in a widthwise direction of the printing medium simultaneously in conjunction with, for example, a set of rack-and-pinion gear. The guide-locking assembly may include a rotation rod, which may rotate in conjunction with an open/close motion of an upper cover of the label printer. The rotation rod may lock the pinion gear as the upper cover is closed so that the paired guides may be restricted from moving.

SUMMARY

In order to load the roll of printing medium in the printing apparatus, a user may move the paired guides in the widthwise direction to fit with a width of the roll. However, due to an erroneous or accidental operation by the user, the guide-locking assembly may be moved to lock the paired guides against the user's intention. As a result, the paired guides may be restricted from moving, and the roll may not be loaded correctly in the printing apparatus.

The present disclosure is advantageous in that a printing apparatus, in which a roll of printing medium may be correctly loaded, is provided.

According to an aspect of the present disclosure, a printing apparatus having a body, a cover, a pair of supporting parts, a locking member, and an engaging portion, is provided. The body includes a container compartment, which is configured to store a roll including a rolled recording medium. The roll is stored in the container compartment with a width thereof aligning with a first direction. The container compartment is open toward one side of the body in a second direction, which is orthogonal to the first direction. The cover is configured to be closable to cover an opening of the container compartment and openable to uncover the opening of the container compartment. The pair of supporting parts are arranged in the container compartment and configured to support sides of the roll along the first direction. At least one of the pair of supporting parts is a movable supporting part configured to be movable in the first direction. The locking member is arranged on the movable supporting part. The locking member is movable between a locked position, in which the locking member restricts the movable supporting part from moving under a condition where the cover is closed, and an unlocked position, in which the locking member allows the movable supporting part to move under a condition where the cover is open. The engaging portion is arranged in the container compartment and configured to engage with the locking member being located at the locked position. The movable supporting part has an opposing face arranged to face the cover under the condition where the cover is closed, a first face, and a second face facing opposite to the first face in the first direction. The first face includes a contact face, which is configured to contact one of the sides of the roll in the first direction. The locking member includes a contact portion at a position where the contact portion does not protrude from the opposing face, on a side of the movable supporting part toward the second face. The cover includes a protrusive portion configured to contact the contact portion. The locking member at the unlocked position under the condition where the cover is open is separated from the engaging portion. In a process where the cover being open is moved to be closed, the protrusive portion of the cover is configured to contact to be pressed against the contact portion of the locking member, causing the locking member to shift from the unlocked position to the locked position to be engaged with the engaging portion.

According to another aspect of the present disclosure, a printing apparatus having a body, a cover, a pair of supporting parts, a locking member, and an engaging portion, is provided. The body includes a container compartment, which is configured to store a roll including a rolled recording medium. The roll is stored in the container compartment with a width thereof aligning with a first direction. The container compartment is open toward one side of the body in a second direction, which is orthogonal to the first direction. The cover is configured to be closable to cover an opening of the container compartment and openable to uncover the opening of the container compartment. The pair of supporting parts are arranged in the container compartment and configured to support sides of the roll along the first direction. At least one of the pair of supporting parts is a movable supporting part configured to be movable in the first direction. The locking member is arranged on the movable supporting part. The locking member is movable between a locked position, in which the locking member restricts the movable supporting part from moving under a condition where the cover is closed, and an unlocked position, in which the locking member allows the movable supporting part to move under a condition where the cover is open. The engaging portion is arranged in the container compartment and configured to engage with the locking member being located at the locked position. The movable supporting part has an opposing face arranged to face the cover under the condition where the cover is closed, a first face, and a second face facing opposite to the first face in the first direction. The first face includes a contact face, which is configured to contact one of the sides of the roll in the first direction. The locking member includes a contact portion at a first position where the contact portion protrudes from the opposing face, on a side of the movable supporting part toward the second face. The cover includes a protrusive portion configured to contact the contact portion. The locking member at the unlocked position under the condition where the cover is open is separated from the engaging portion. In a process where the cover being open is moved to be closed, the protrusive portion of the cover is configured to contact to be pressed against the contact portion of the locking member and move the contact portion from the first position to a second position, which is on a side opposite to the first position from the opposing face in the second direction, causing the locking member to shift from the unlocked position to the locked position to be engaged with the engaging portion.

BRIEF DESCRIPTION OF THE ACCOMPANYING DRAWINGS

FIG. 3A is a perspective view of a bottom case 2A and a frame 8 in a body 2 of the printing apparatus 1 according to the embodiment of the present disclosure. FIG. 3B is a partially enlarged perspective view of the frame 8 in the printing apparatus 1 according to the embodiment of the present disclosure.

Figure 2:
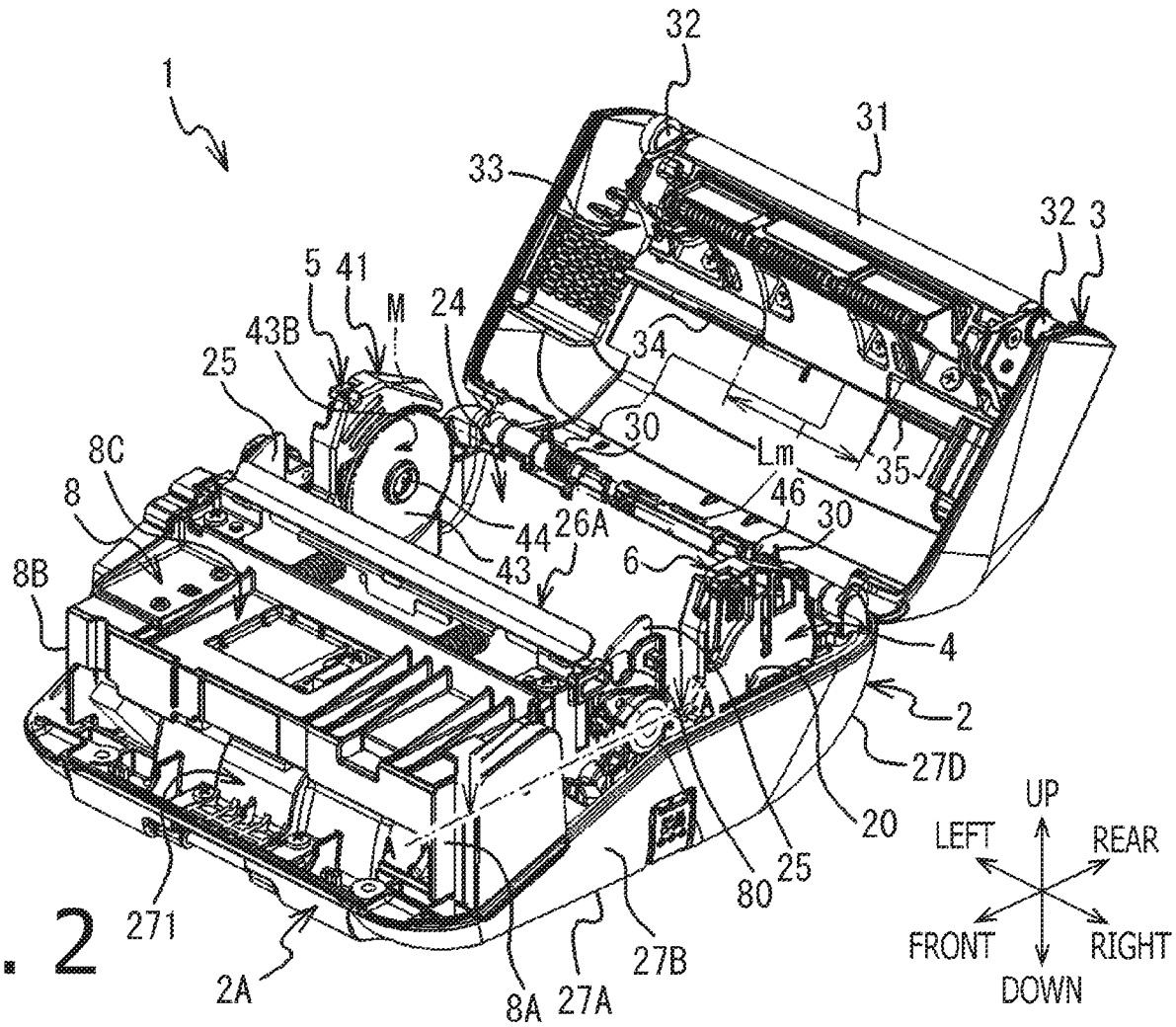
FIG. 2 is a perspective view of the printing apparatus 1, with the cover 3 being open and a front hood 2B being removed, according to the embodiment of the present disclosure.
Figure 4A:
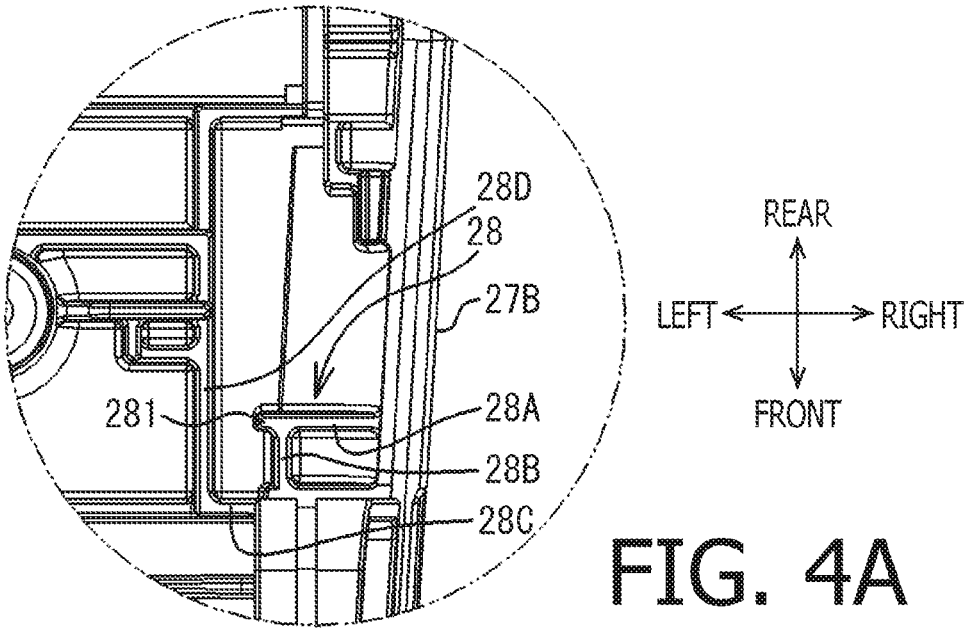
Figure 4B:
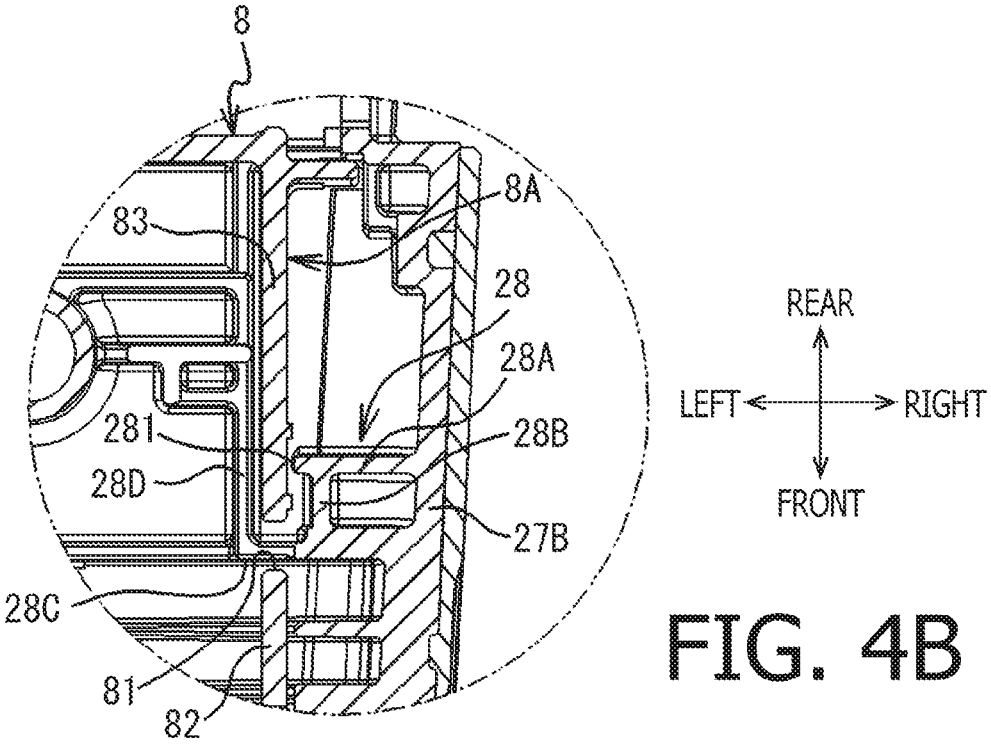

FIGS. 4A and 4B are cross-sectional partial views of the printing apparatus 1 according to the embodiment of the present disclosure, with the frame 8 and without the frame 8, respectively, viewed at a line A-A along an arrow shown in FIG. 2.

Figure 5:
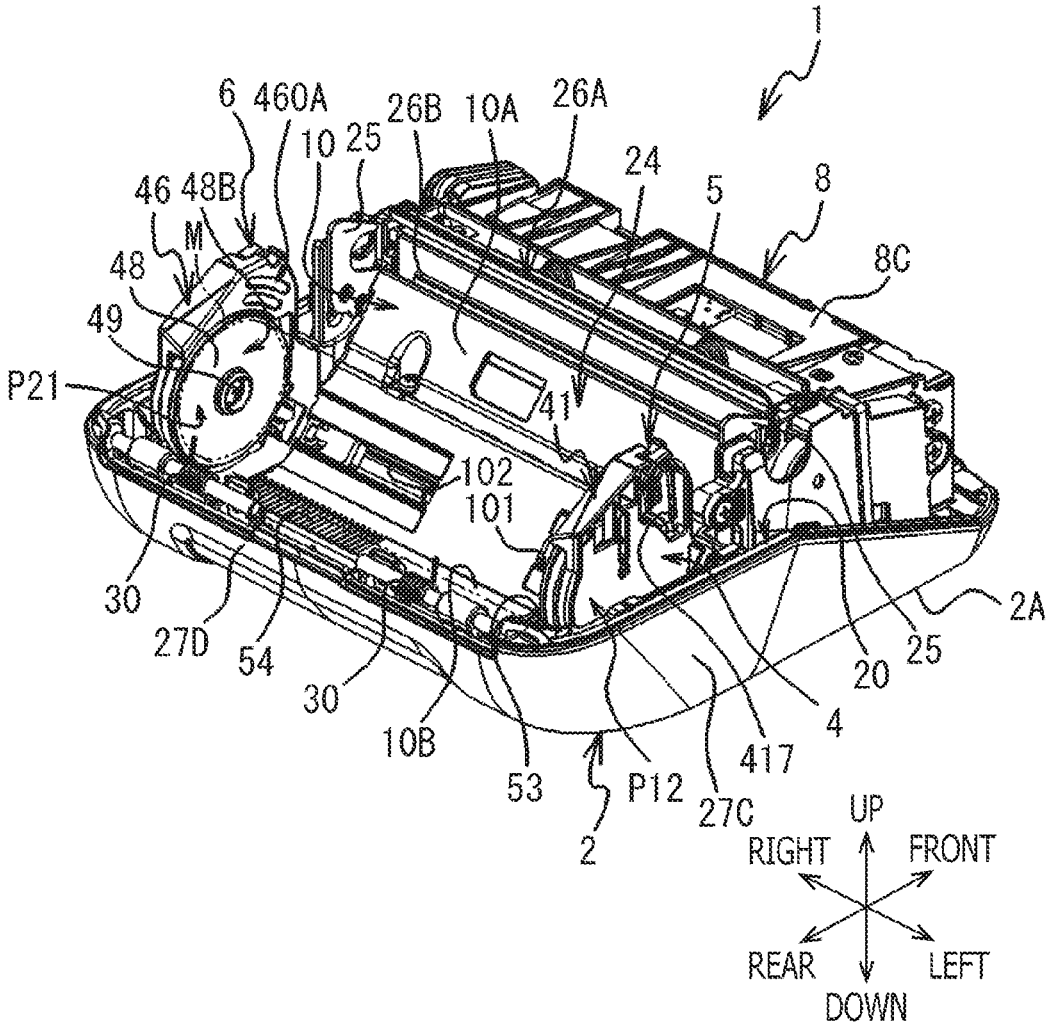

FIG. 5 is a perspective view of a container compartment 24 in the printing apparatus 1 according to the embodiment of the present disclosure.

Figure 6:
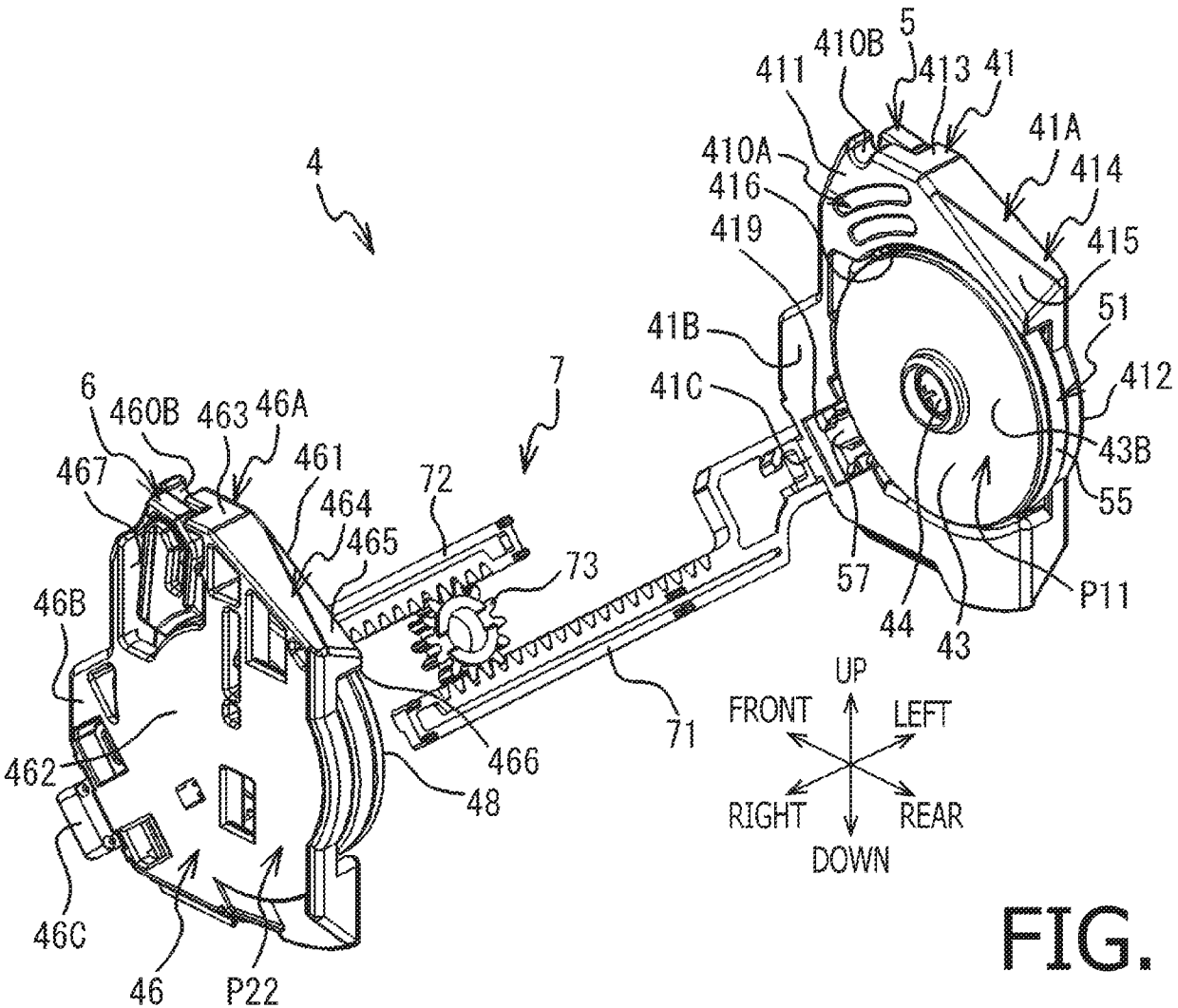

FIG. 6 is a perspective view of a pair of supporting parts 4, locking members 5, 6, and an adjustor 7 for the printing apparatus 1 according to the embodiment of the present disclosure.

Figure 7:
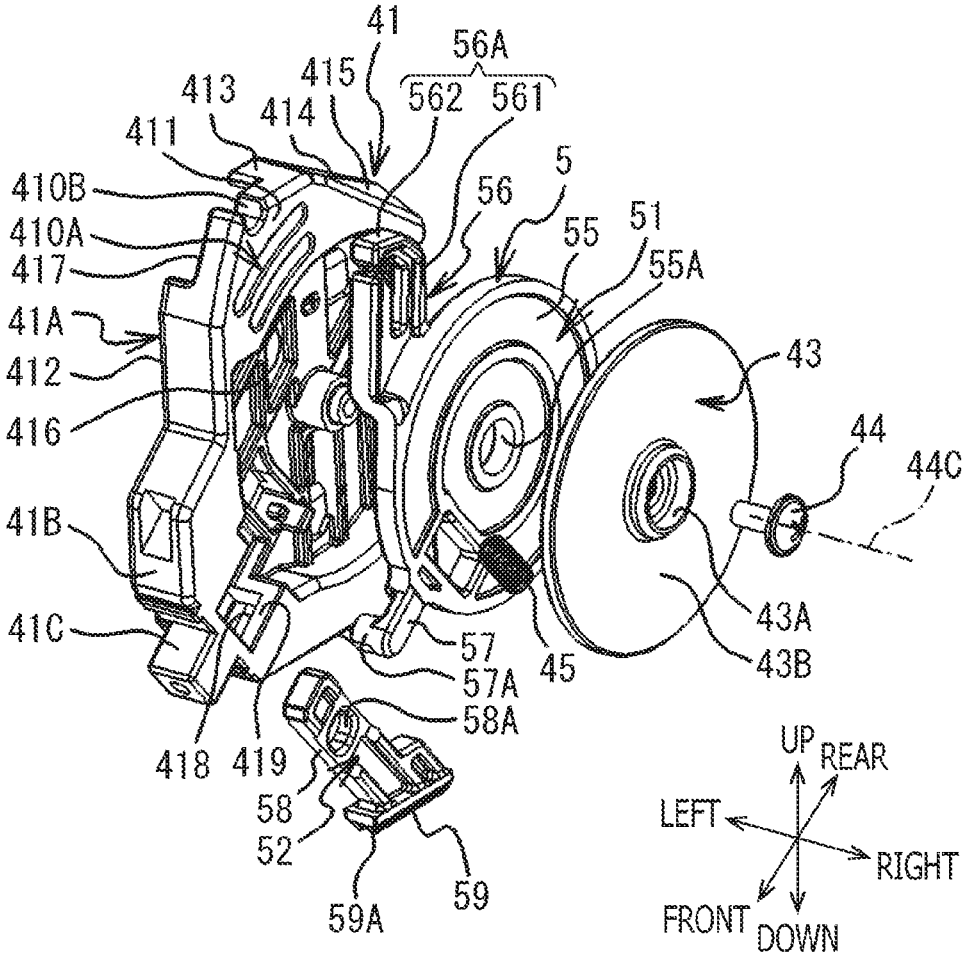

FIG. 7 is a perspective view of a supporting part 41, the locking member 5, and a rotary disk 43 for the printing apparatus 1 according to the embodiment of the present disclosure.

Figure 8:
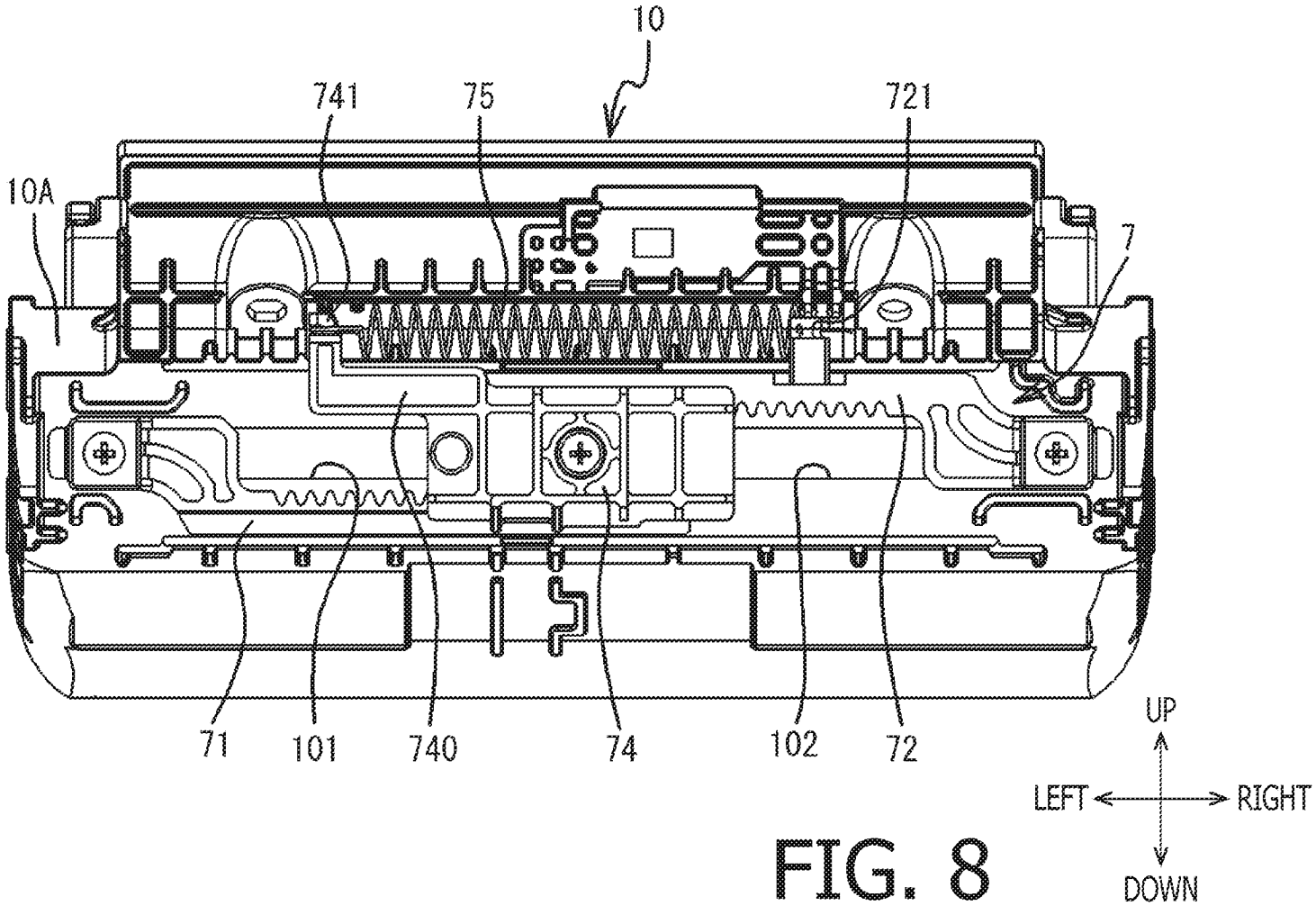

FIG. 8 is a frontward view of the adjuster 7 for the printing apparatus 1 according to the embodiment of the present disclosure.

Figure 9:
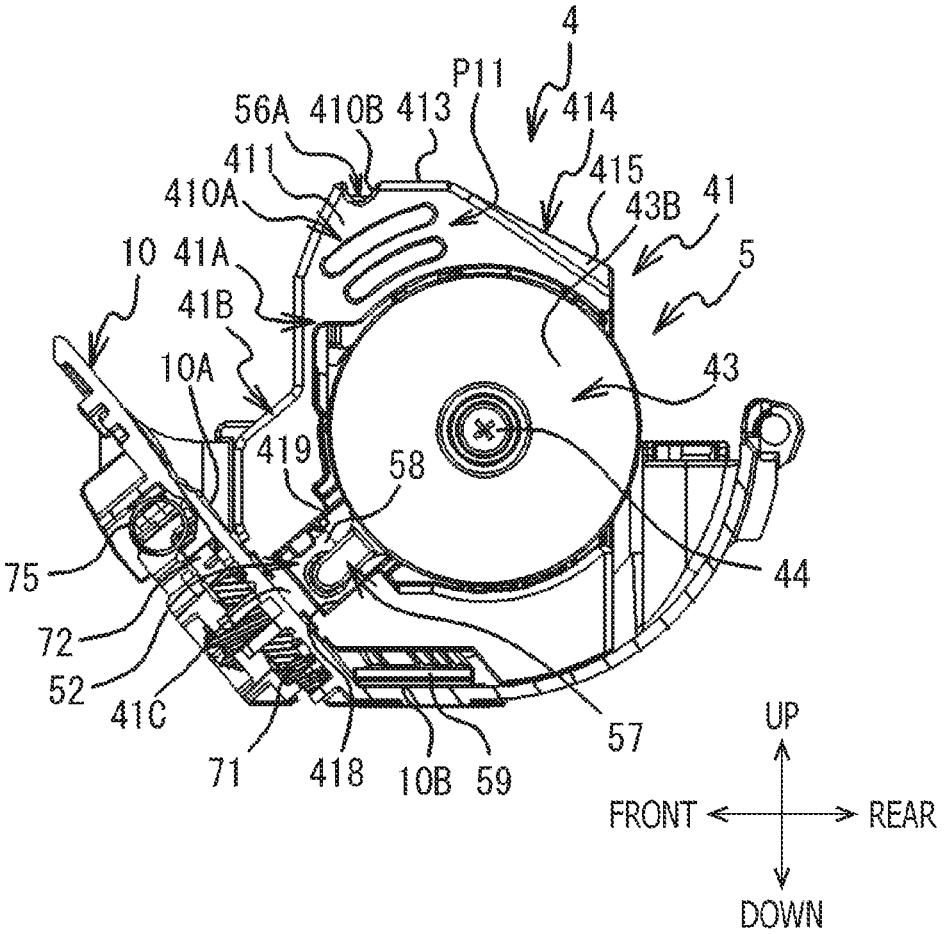

FIG. 9 is a sideward view of the supporting part 41, the locking member 5, and the rotary disk 43 for the printing apparatus 1 according to the embodiment of the present disclosure.

Figure 10A:
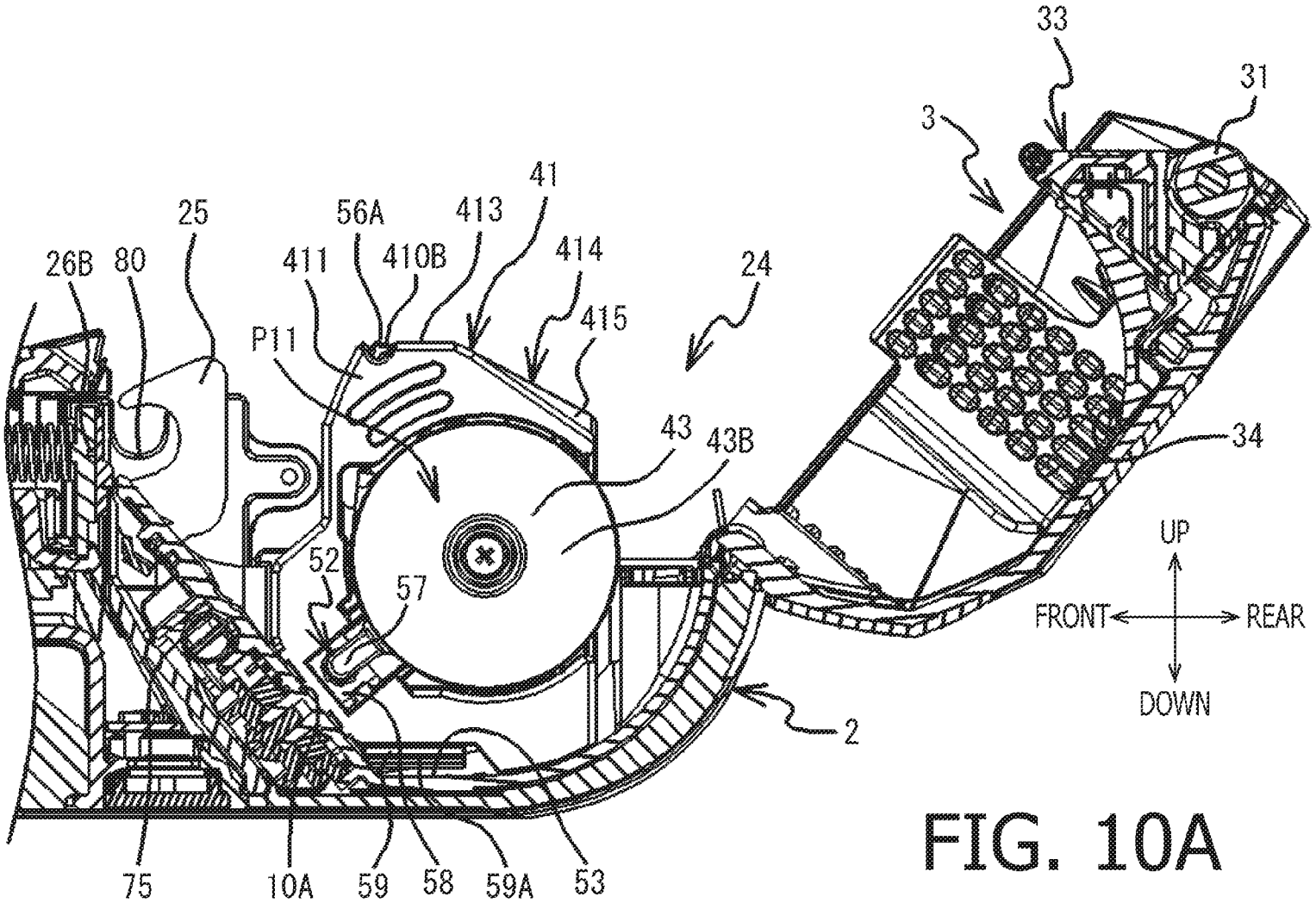
Figure 10B:
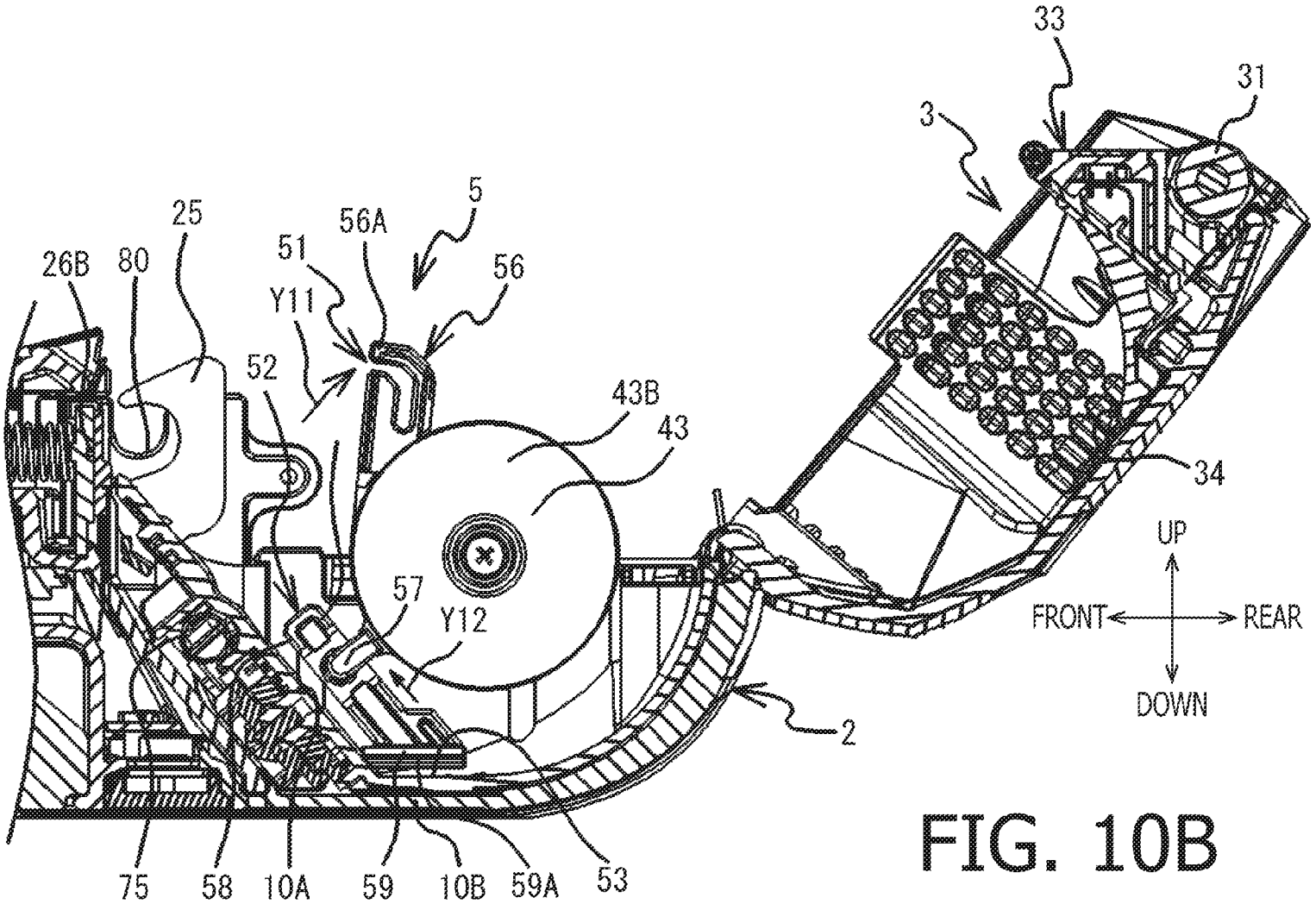
Figure 10C:
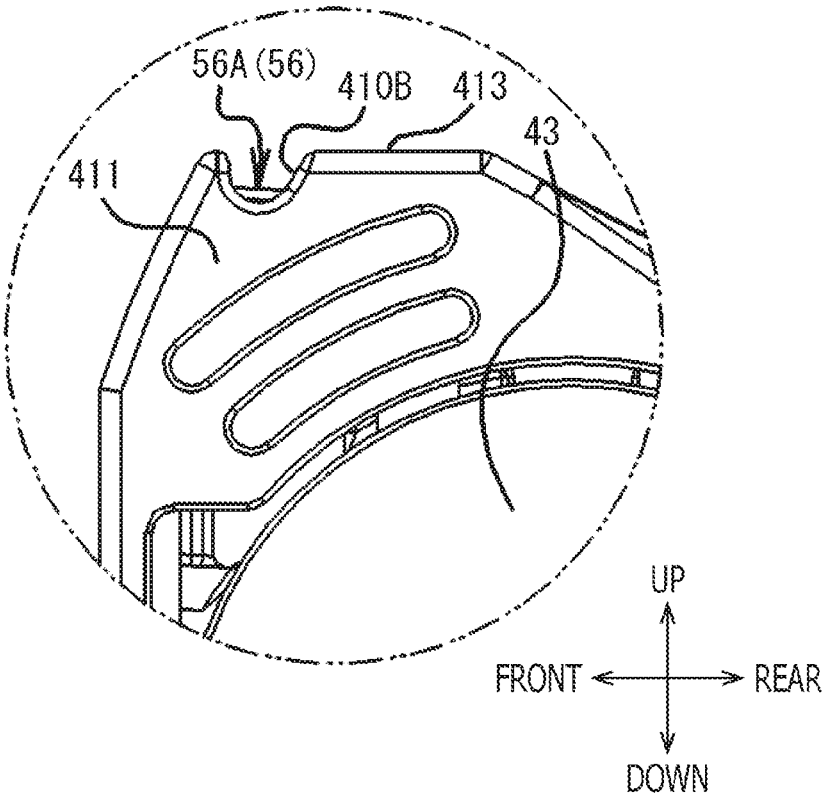

FIGS. 10A-10B are cross-sectional views of the locking member 5 in the printing apparatus 1 when the cover 3 is at an open position according to the embodiment of the present disclosure. FIG. 10C is an enlarged sideward view of a contact portion 56 in the printing apparatus 1 according to the embodiment of the present disclosure.

Figure 11A:
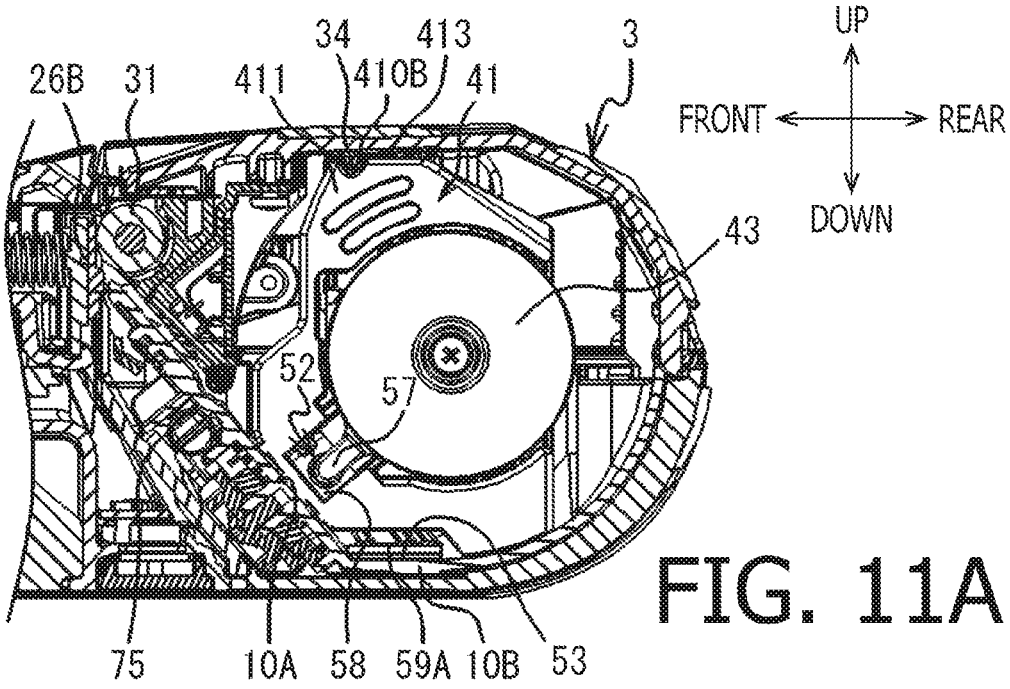
Figure 11B:
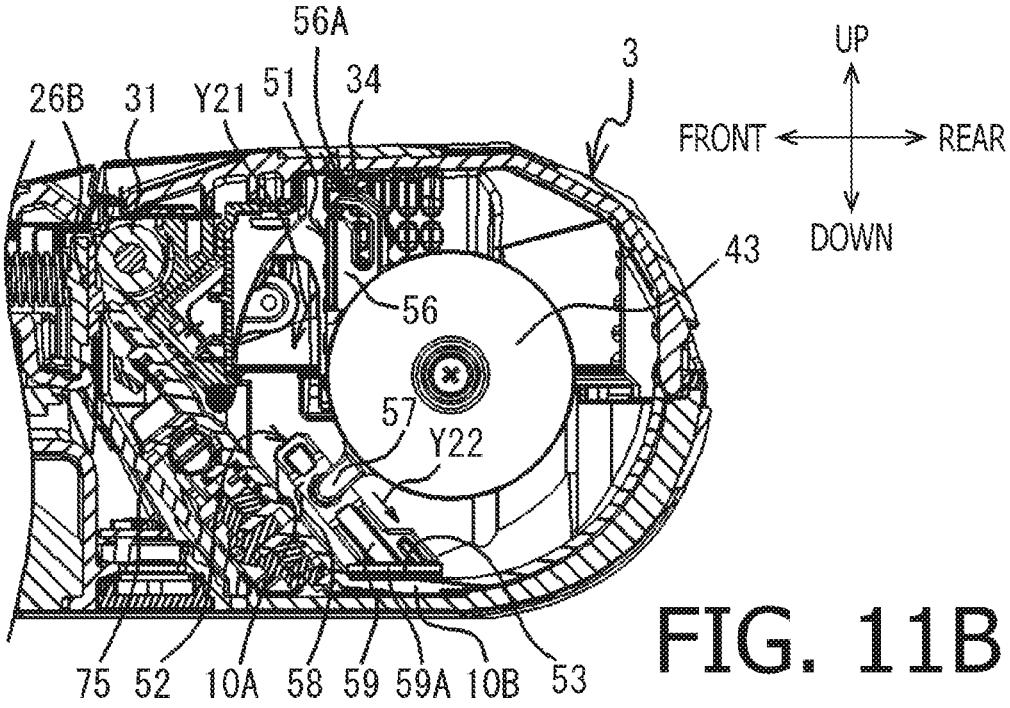

FIGS. 11A and 11B are cross-sectional views of the locking member 5 in the printing apparatus 1 when the cover 3 is at a closed position according to the embodiment of the present disclosure.

Figure 12A:
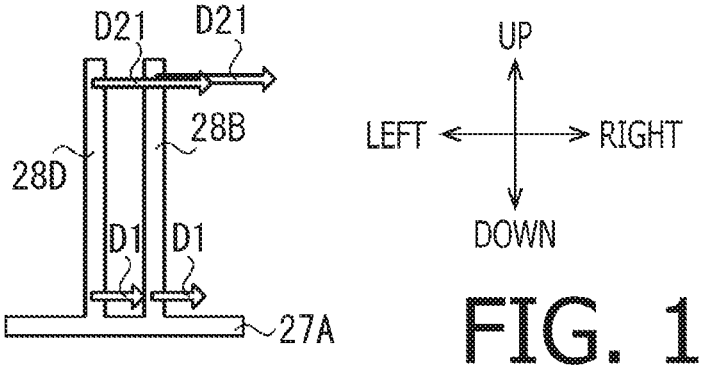
Figure 12B:
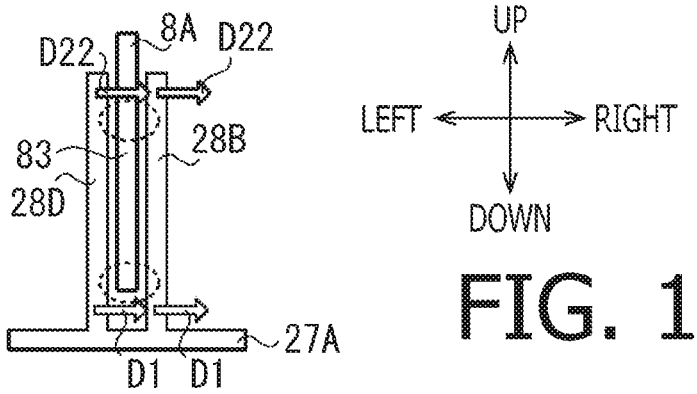

FIGS. 12A and 12B are a schematic view of the frame 8 to illustrate deformation resistibility by a side board 8A in the printing apparatus 1 according to the embodiment of the present disclosure.

Figure 13:
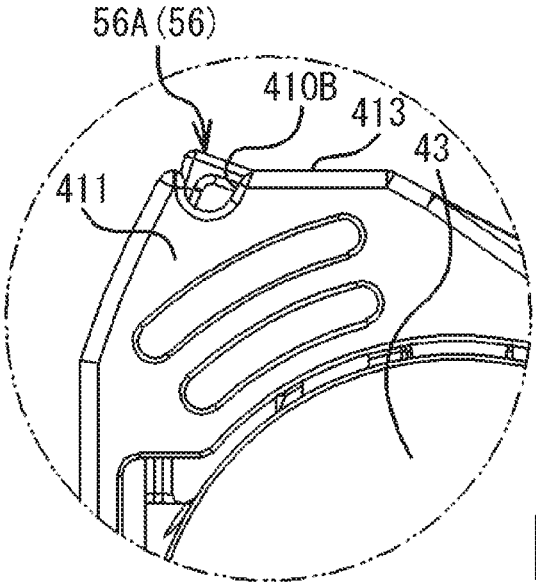

FIG. 13 is an enlarged sideward view of the contact portion 56 at a first position in the printing apparatus 1 according to a modified example the embodiment of the present disclosure.

DETAILED DESCRIPTION

Hereinafter, an embodiment of the present disclosure will be described with reference to the accompanying drawings.

A printing apparatus 1 is connectable with an external terminal (not shown) through a USB (registered trademark) cable. The printing apparatus 1 may print images, including characters such as text and figures, on a printing medium, which may be a thermosensitive tape. The external terminal may be a personal computer (PC). The printing apparatus 1 may be driven by a battery. The printing apparatus 1 may have a belt-attachable clip (not shown), by which the printing apparatus 1 may be attached to a belt on a user and carried by the user.

In the following description, directions related the printing apparatus 1 and each part or item included in the printing apparatus 1 will be mentioned on basis of indications by arrows in each drawing. For example, in FIG. 1, a viewer's a lower-rightward side, an upper-leftward side, an upper-rightward side, a lower-leftward side, an upper side, and a lower side will be referred to as a rightward side, a leftward side, a rearward side, a frontward side, an upper side, and a lower side, respectively, for the printing apparatus 1. A front-to-rear or a rear-to-front direction may be referred to as a front-rear direction, a left-to-right or right-to-left direction may be referred to as a widthwise direction, and an up-to-down or down-to-up direction may be referred to as a vertical direction.

<Body 2>

Figure 1:
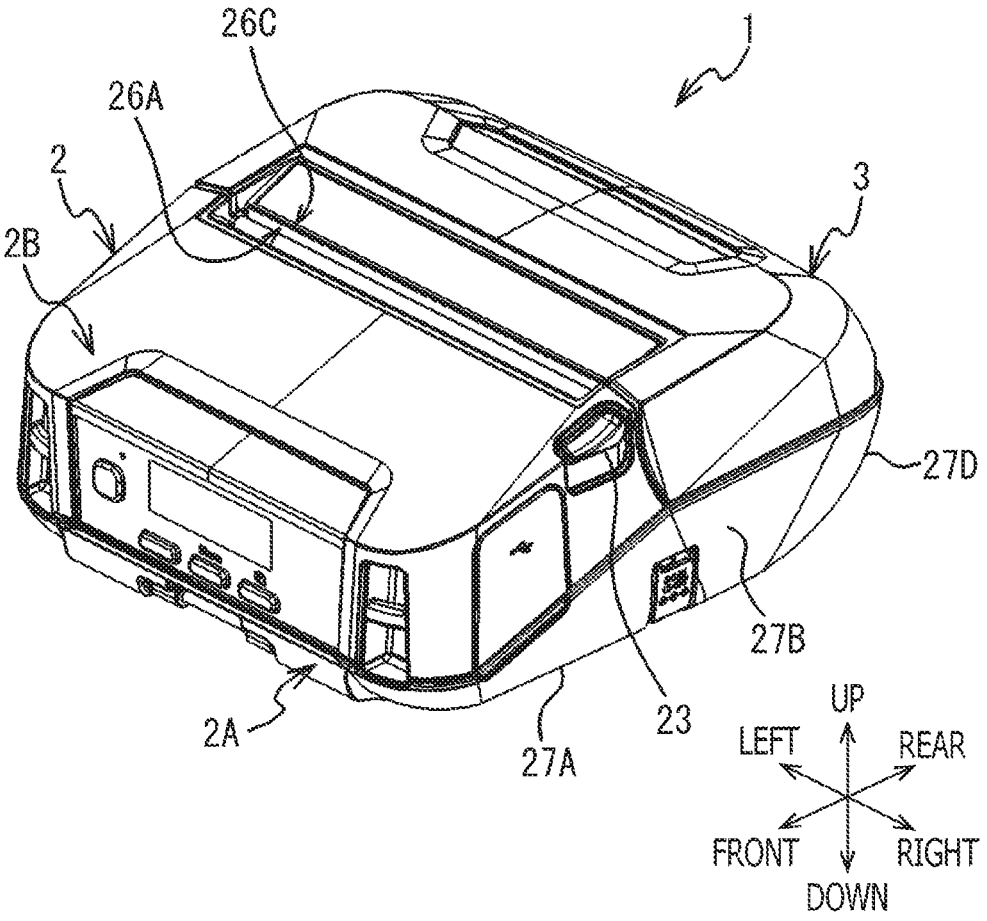
FIG. 1 is a perspective view of a printing apparatus 1, with a cover 3 being closed, according to an embodiment of the present disclosure.

As shown in FIG. 1, the printing apparatus 1 includes a body 2 and a cover 3. The body 2 may have an approximate shape of a six-sided box. The body 2 includes a bottom case 2A and a front hood 2B. The bottom case 2A covers an interior of the printing apparatus 1 from below, and the front hood 2B covers an approximately front half of the interior of the printing apparatus 1 from above. FIG. 2 shows the cover 3 being open and the front hood 2B being removed. As shown in FIG. 2, the body 2 has a container compartment 24 in a rearward half area in the bottom case 2A. The container compartment 24 may be exposed open through an opening 20, which is formed in the body 2. The container compartment 24 may therein store a roll M, which may include a tubular core and an adhesive tape with a thermosensitive label rolled around the core.

At a frontward position in the opening 20 in the body 2, arranged is a cutter 26A. The cutter 26A may cut a part of the tape with an image printed thereon off from the roll M. At a lower position with respect to the cutter 26A, arranged is a thermal head 26B (see FIG. 5), which may print characters by heat on the thermosensitive label. The cutter 26A and the thermal head 26B extend longitudinally in the widthwise direction. Inside the body 2, at each widthwise end position in the opening 20, arranged is an engaging portion 25. The engaging portions 25 are swingably supported at lower ends thereof by the body 2. When the user pushes a lever 23 (see FIG. 1), which is arranged on a leftward side of the body 2, downward, upper ends of the engaging portions 25 may swing rearward.

As shown in FIG. 3, the bottom case 2A includes a bottom wall 27A and side walls 27B, 27C, 27D. The bottom wall 27A forms an underside of the body 2. At a position in the vicinity of a front end of the bottom wall 27, formed is a bulge portion 271, which curves upward. In a room inside the bulge portion 271, stored is a battery (not shown), which may activate the printing apparatus 1. The side walls 27B, 27C, 27D extend upward from a rightward end, a leftward end, and a rearward end of the bottom wall 27A, respectively.

On an upper surface of the bottom wall 27A, at a position rightward from the bulge portion 271 and leftward from the side wall 27B, arranged is a rib 28. The rib 28 includes extending portions 28A, 28B, 28C, 28D. The extending portions 28A-28D each has a form of a plate and extends upward from the bottom wall 27A. As shown in FIG. 4A, the extending portion 28A extends orthogonally to the front-rear direction, leftward from the side wall 27B. The extending portion 28B extends orthogonally to the widthwise direction, frontward from a position rightward to a small extent from a leftward end of the extending portion 28A. In other words, the leftward end of the extending portion 28A protrudes leftward with respect to the extending portion 28B. In the following paragraphs, the part at the leftward end of the extending portion 28A protruded leftward from the extending portion 28B may be called as a protrusive portion 281. The extending portion 28C extends orthogonally to the front-rear direction, leftward and rightward from a front end of the extending portion 28B. A rightward end of the extending portion 28C is connected with the side wall 27B. The extending portion 28D extends orthogonally to the widthwise direction, rearward from a leftward end of the extending portion 28C. The extending portions 28B, 28D extend in parallel with each other at positions apart in the widthwise direction. Between the protrusive portion 281 of the extending portion 28A and the extending portion 28D, formed is a clearance. As shown in FIG. 3B, a position of the upper ends of the protrusive portions 28C, 28D in the vertical direction is lower than a position of the upper ends of the extending portions 28A, 28B. In other words, a height of the extending portions 28C, 28D is smaller than a height of the extending portions 28A, 28B.

As shown in FIG. 2, in an area interposed vertically between the bottom wall 27A and the front hood 2B (see also FIG. 1) in the body 2, fixed is a frame 8. The frame 8 may be formed in a fiber-reinforced plastic resin containing glass fiber. Meanwhile, the body 2 may be formed in a common synthetic resin, which does not contain glass fiber. In this regard, the frame 8 may be more rigid than the body 2. Meanwhile, the cover 3 may be formed in the same synthetic resin as the body 2. The frame 8 may support a head holder to hold a control board, a communication board, a power board, a motor, which are not shown, and a thermal head 26B (see FIG. 5). As shown in FIG. 3A, the frame 8 includes side boards 8A, 8B and a bridge portion 8C. The side boards 8A, 8B each has a shape of a board spreading orthogonally to the widthwise direction. The side boards 8A, 8B are apart from each other in the widthwise direction. In particular, the side board 8A is arranged at a leftward position with respect to the side wall 27B of the bottom case 2A, and the side board 8B is arranged at a rightward position with respect to the side wall 27C of the bottom case 2A. At a position rearward with respect to a center in the front-rear direction on each upper edge of the side boards 8A, 8B, formed is a recess 80, which dents downward. The bridge portion 8C extends between the side boards 8A, 8B at a frontward position with respect to the center of the side boards 8A, 8B in the front-rear direction.

At an approximately central position in the front-rear direction on a lower edge of the side board 8A, formed is a groove 81, which recesses upward. The groove 81 engages with the extending portion 28C in the rib 28 at the bottom case 2A from above. As shown in FIG. 4B, a front portion 82 of the side board 8A, which is at a frontward position with respect to the groove 81, is arranged at a frontward position with respect to the extending portion 28C of the rib 28. A rear portion 83 of the side board 8A, which is at a rearward position with respect to the groove 81, is arranged at a rearward position with respect to the extending portion 28C of the rib 28. The rear portion 83 is arranged between the extending portion 28B and the extending portion 28D of the rib 28 and extends in parallel with the extending portions 28B, 28D. The protrusive portion 281 and the extending portion 28D flank a part of the rear portion 83 sideward on the left side and the right side, respectively. In other words, a part of the rear portion 83 is interposed between the protrusive portion 281 and the extending portion 28D in the widthwise direction.

<Cover 3>

As shown in FIGS. 1-2, the cover 3 is swingably supported at lower end thereof by an upper end of the side wall 27D of the body 2. The cover 3 may swing about the lower end thereof between a closed position (see FIG. 1) and an open position (see FIG. 2). The cover 3 may cover the container compartment 24, which is below the opening 20, from above when the cover 3 is in the closed position (see FIG. 1) and may uncover the container compartment 24 open when the cover 3 is in the open position (see FIG. 2). As shown in FIG. 2, the cover 3 is urged by an urging member 30 in a direction from the closed position toward the open position, e.g., upward. In the following description, positions and directions related to the cover 3 comply with those of the printing apparatus 1 under a condition, where the cover 3 is at the closed position (see FIG. 1).

As shown in FIG. 2, a platen holder 33 to support a platen roller 31 rotatably is arranged at a frontward area in the cover 3. The platen roller 31 is rotatable about a rotation shaft, which extends in the widthwise direction. A bearing 32 in a tubular shape is arranged at each widthwise end of the rotation shaft of the platen roller 31 to extend outward in the widthwise direction. The bearings 32 are caught in the recesses 80 in the frame 8 from below when the cover 3 is at the closed position. Meanwhile, the engaging portions 25 on the right and the left, when the cover 3 is at the closed position, catch the bearings 32 on the right and the left to hold from above, respectively, so that the cover 3 may be maintained at the closed position (see FIG. 1). When the cover 3 is at the closed position, and when the lever 23 (see FIG. 1) is pushed downward, the engaging portions 25 may release the bearings 32 so that the cover 3 may swing upward by the urging force of the urging member 30 from the closed position (see FIG. 1) to the open position (see FIG. 2).

As shown in FIG. 1, when the cover 3 is in the closed position, the platen roller 31 (see FIG. 2) is placed to be closer to the thermal head 26B (see FIG. 5) than in the open position. The platen roller 31 may, when the tape is located between the platen roller 31 and the thermal head 26B, press the tape against the thermal head 26B. The platen roller 31 may be rotated by a motor (not shown) to press the tape against the thermal head 26B and convey the tape simultaneously. An outlet 26C is formed at a position between the cutter 26A and the platen roller 31 when the cover 3 is in the closed position so that the tape with the image printed thereon in the printing apparatus 1 may be ejected through the outlet 26C.

As shown in FIG. 2, the cover 3 includes protrusive portions 34, 35, which are located rearward with respect to the platen holder 33 when the cover 3 is at the closed position. The protrusive portion 34 is located leftward with respect to a widthwise center of the cover 3, and the protrusive portion 35 is located rightward with respect to the widthwise center of the cover 3. The protrusive portions 34, 35 extend linearly in the widthwise direction and are spaced apart from each other in the widthwise direction. A distance Lm between the protrusive portions 34, 35 is shorter than a width of a roll M having a smallest width among rolls M that are loadable in the printing apparatus 1. The protrusive portions 34, 35 protrude downward from a downward surface of the cover 3 being at the closed position.

<Holder 10>

A holder 10 (see FIG. 5) is fixed to the container compartment 24. The holder 10 may rotatably hold the roll M, which may be set in such an orientation that the width thereof aligns with the widthwise direction. The holder 10 includes fixed parts 10A, 10B; a pair of supporting parts 4 which include supporting parts 41, 46; locking members 5, 6; rotary disks 43 (see FIG. 2), 48; and an adjustor 7 (see FIG. 6).

The fixed parts 10A, 10B are each in a shape of a plate. The fixed part 10A is located rearward with respect to the bridge portion 8C of the frame 8 and spreads to incline with respect to a horizontal direction to be higher toward the front and lower toward the rear. The fixed part 10A includes grooves 101, 102 (see FIG. 8), which extend linearly on a same line along the widthwise direction but are spaced apart from each other in the widthwise direction. The groove 102 is arranged on a rightward side with respect to the groove 101.

The fixed part 10B is connected to a rearward and lower end of the fixed part 10A. The fixed part 10B extends horizontally along the bottom case 2A of the body 2. The fixed part 10B includes engaging portions 53, 54. Each engaging portion 53, 54 has a plurality of teeth, which align with the widthwise direction and extend longitudinally in the front-rear direction. The engaging portions 53, 54 are arranged linearly on a same line along the widthwise direction and are spaced apart from each other along the widthwise direction. The engaging portion 54 is arranged on a rightward side with respect to the engaging portion 53.

<Pair of Supporting Parts 4>

As shown in FIG. 5, the pair of supporting parts 4 are arranged on a rearward side with respect to the fixed part 10A. The supporting parts 4 includes the supporting part 41, which is arranged on the left, and the supporting part 46, which is arranged on the right. The supporting part 41 and the supporting part 46 face each other along the widthwise direction to support a leftward side and a rightward side of the roll M, respectively. The supporting parts 41, 46 may be symmetrical. In the following paragraphs, the supporting part 41 may be described in detail while description of the supporting part 46 may be omitted. The supporting part 41 includes a base portion 41A, an extended portion 41B, and a protrusive portion 41C. The supporting part 46 includes a base portion 46A, an extended portion 46B, and a protrusive portion 46C, which correspond to the base portion 41A, the extended portion 41B, and the protrusive portion 41C, respectively in the supporting part 41.

As shown in FIG. 7, the base portion 41A has an inner lateral face 411, an outer lateral face 412, an opposing face 413, and an oblique face 414. The inner lateral face 411 is located at a rightward end of the base portion 414A and spreads orthogonally to the widthwise direction. On the inner lateral face 411, formed is a round-shaped hole 416, in which a base portion 55 and the rotary disk 43 in a locking member 5 are placed to be fitted. The locking member 5 will be described further below. As shown in FIG. 6, on the inner lateral face 411, at upper-frontward positions with respect to a rotary disk 43, which will be described further below, formed are two (2) arc-shaped grooves. In the following paragraphs, the grooves will be called as finger-hooking portion 410A. The inner lateral face 411 is located on a same plane as a rightward face, in particular, a contact face 43B, of the rotary disk 43. In the following paragraphs, a face of the base portion 41A including the inner lateral face 411 and the contact face 43B may be called as a first face P11. The first face P11 is located on a rightward side of the supporting part 41 and faces rightward.

As shown in FIG. 7, the outer lateral face 412 is located at a leftward end of the base portion 41A and spreads orthogonally to the widthwise direction. The outer lateral face 412 covers the hole 416 in the inner lateral face 411 from the left. On the outer lateral face 412, at a leftward position with respect to the inner lateral face 411, formed is a hole 417 (see FIG. 5). In the following paragraphs, a face of the base portion 41A including the outer lateral face 412, which is opposite to the first face P11 in the widthwise direction, may be called as a second face P12 (see FIG. 5). The second face P12 is located on a leftward side of the supporting part 41 and faces leftward.

In the following paragraphs, a position in relation to the supporting part 41 closer to the first face P11 than the second face P12 in the widthwise direction may be expressed as a position on a side of the supporting part 41 toward the first face P11, and a position in relation to the supporting part 41 closer to the second face P12 than the first face P11 in the widthwise direction may be expressed as a position on a side of the supporting part 41 toward the second face P12. In other words, the side of the supporting part 41 toward the first face P11 and the side of the supporting part 41 toward the second face P12 may be divided at a widthwise intermediate position of the supporting part 41 between the first face P11 and the second face P12. In this regard, the position on the side of the supporting part 41 toward the first face P11 may include a position on the first face P11, and the position on the side of the supporting part 41 toward the second face P12 may include a position on the second face P12.

The opposing face 413 spreads orthogonally to the vertical direction and extends leftward from a frontward part of the upper end of the inner lateral face 411. The opposing face 413 is arranged to vertically face the cover 3 being at the closed position. At a frontward position with respect to the opposing face 413, formed is a recessed portion 410B, which dents downward, having a cross-sectional shape of U in a lateral view (see FIG. 9). The recessed portion 410B is deepened in a direction opposite to a direction, in which the opposing face 413 faces toward the cover 3 being at the closed position. A lower end, i.e., a bottom, of the recessed portion 410B is located to be higher than a position of an outer circumferential surface of a roll M (e.g., an unused roll M), when loaded, having a largest diameter among rolls M that are loadable in the printing apparatus 1. Meanwhile, a dimension between upper edges of the recessed portion 410B in the front-rear direction, in other words, a dimension of an opening of the recessed portion 410B in the front-rear direction, is larger than a maximum dimension in the front-rear direction of the protrusive portion 34, 35 of the cover 3.

As shown in FIG. 6, the oblique face 414 inclines obliquely lower-rearward from a rear end of the opposing face 413. The oblique face 414 narrows in the widthwise direction toward the rear. Between the inner lateral face 411 and the oblique face 414, arranged is an oblique portion 415, which spreads in a direction to intersect with the inner lateral face 411 and the oblique face 414. The oblique portion 415 is located at a position closer toward the upper side of the body 2, i.e., higher, than the contact face 43B of the rotary disk 43 and inclines with respect to the contact face 43B. The oblique portion 415 inclines lower-rightward from an end closer to the second face P12 toward another end closer to the first face P11. In other words, a direction, along which the oblique portion 415 extends from one end on the side toward the second face P12 toward another end on the side toward the first face P11, inclines rightward as the oblique portion 415 extends from a higher position toward a lower position.

As shown in FIG. 7, the extended portion 41B extends lower-frontward from a position lower than a vertical center of a frontward end of the base portion 41A. The extended portion 41B has holes 418, 419, in which parts of the locking member 5 may be inserted. In particular, a protrusive portion 57A in a first locking member 51 and a base portion 58 in the second locking member 52 of the locking member 5 may be inserted in the holes 418, 419, respectively. The configuration of the locking member 5 will be described later more in detail. The hole 418 is formed to be open at a lower end of the extended portion 41B and bored obliquely upper-frontward in a lower part of the extended portion 41B. The hole 419 is formed to be open at a rightward end of the extended portion 41B and bored leftward. The hole 419 and the hole 418 communicate inside the extended portion 41B.

The protrusive portion 41C protrudes obliquely lower-frontward from a lower-frontward end of the extended portion 41B. The protrusive portion 41C is inserted in the groove 101 (see FIG. 8) formed in the fixed part 10A from the rear side to protrude frontward with respect to the fixed part 10A.

As shown in FIG. 6, the supporting part 46 includes the base portion 46A, the extended portion 46B, and the protrusive portion 46C, which are mentioned earlier. In the base portion 46A, an inner lateral face 461, an outer lateral face 462, an opposing face 463, an oblique face 464, an oblique portion 465, holes 466, 467, a finger-hooking portion 460A (see FIG. 5), a recess 460B, a first face P21 (see FIG. 5), and a second face P22 are in configurations corresponding to the inner lateral face 411, the outer lateral face 412, the opposing face 413, the oblique face 414, the oblique portion 415, the holes 416, 417, the finger-hooking portion 410A, the recessed portion 410B, the first face P11, and the second face P12, respectively, in the base portion 41A in the supporting part 41. The oblique portion 465 inclines between the first face P21 and the second face P22 lower-rightward from an end closer to the second face P22 toward another end closer to the first face P21. In other words, a direction, along which the oblique portion 465 extends from one end on the side toward the second face P22 toward another end on the side toward the first face P21, inclines leftward as the oblique portion 465 extends from a higher position toward a lower position. The protrusive portion 46C is inserted in the groove 102 (see FIG. 8) formed in the fixed part 10A from the rear side to protrude frontward with respect to the fixed part 10A.

<Adjustor 7>

The adjustor 7 allows the pair of supporting parts 4 to move in the widthwise direction in conjunction with each other. The adjustor 7 is, as shown in FIG. 8, arranged at a frontward position with respect to the fixed part 10A. The adjustor 7 includes, as shown in FIG. 6, rack gears 71, 72, a pinion gear 73, a supporting plate 74 (see FIG. 8), and a contractive spring 75 (see FIG. 8).

The rack gears 71, 72 face each other vertically. The rack gear 72 is arranged at an upper position with respect to the rack gear 71. The rack gears 71, 72 extend longitudinally in the widthwise direction. The rack gear 71, 72 have teeth at an upper end and a lower end thereof, respectively. The rack gear 71 is connected to the protrusive portion 41C in the supporting part 41 at a leftward end thereof. The rack gear 72 is connected to the protrusive portion 46C in the supporting part 46 at a rightward end thereof. As shown in FIG. 8, the rack gear 72 has a retainer 721, which protrudes upward, at an upper end thereof.

The pinion gear 73 is arranged, as shown in FIG. 6, at a position between the rack gears 71, 72. The pinion gear 73 is rotatably supported at a frontward area in the fixed part 10A (see FIG. 8), between the grooves 101, 102. Teeth of the pinion gear 73 mesh with the teeth in the rack gears 71, 72. The rack gears 71, 72 may move in the widthwise direction along with rotation of the pinion gear 73. Accordingly, the supporting parts 41, 46 may move along the grooves 101, 102 (see FIG. 8) in the widthwise direction. For example, when the supporting part 41 moves leftward for a certain distance, the supporting part 46 may move in conjunction with the supporting part 41 rightward for the same distance through the rack gear 71, the pinion gear 73, and the rack gear 72. In other words, the rack gears 71, 72 and the pinion gear 73 may move the pair of supporting parts 4 in directions to be farther apart from each other, i.e., outward along the widthwise direction. For another example, when the supporting part 41 moves rightward for a certain distance, the supporting part 46 may move in conjunction with the supporting part 41 leftward for the same distance through the rack gear 71, the pinion gear 73, and the rack gear 72. In other words, the rack gears 71, 72 and the pinion gear 73 may move the pair of supporting parts 4 in directions to be closer to each other, i.e., inward along the widthwise direction.

The supporting board 74 is, as shown in FIG. 8, fixed at a frontward position with respect to the pinion gear 73. The supporting board 74 includes an extended portion 740, which extends leftward. At a leftward end area in the extended portion 740, arranged is a retainer 741, which protrudes upward. The contractive spring 75 is hooked to the retainer 741 in the supporting board 74 and to the retainer 721 in the rack gear 72 so that the contractive spring 75 may apply an urging force, acting in a direction to pull the supporting parts 41, 46 closer, i.e., inward along the widthwise direction, to the supporting parts 41, 46.

<Locking Members 5, 6>

As shown in FIG. 6, the locking member 5 is arranged on the supporting part 41, and the locking member 6 is arranged on the supporting part 46. The locking members 5, 6 are symmetrical. In the following paragraphs, the locking member 5 may be described in detail while description of the locking member 6 may be omitted.

As shown in FIG. 7, the locking member 5 includes a first locking member 51 and a second locking member 52. The first locking member has a shape of a plate. The first locking member 51 includes a base portion 55, a contact portion 56, and a coupling portion 57. The base portion 55 has an approximate shape of a disk. A hole 55A is formed at a center of the base portion 55, and a screw 44 is inserted in the hole 55A. An axis extending at a center of a rod of the screw 44 inserted in the hole 55A may be called as a supporting axis 44C.

The contact portion 56 extends leftward from an upper position in a frontward area in the base portion 55 with respect to a vertical center of the base portion 55 and curves to extend upward. The contact portion 56 includes extended portions 561, 562. The extended portion 561 extends upward from a position, at which the contact portion 56 extends from the base portion 55. The extended portion 562 extends frontward from an upper end of the extended portion 561. The extended portions 561, 562 form a contact section 56A. When a downward force from above is applied to the extended portion 562, the extended portion 561 may resiliently deform, and the extended portion 562 may move downward to some extent. When the extended portion 562 is released from the downward force, the extended portion 561 may recover to the original form, and the extended portion 562 may return to the original position.

The coupling portion 57 extends obliquely lower-frontward from a lower position with respect to the vertical center in the base portion 55. The coupling portion 57 includes the protrusive portion 57A, which protrudes leftward, at a lower-frontward end of the coupling portion 57. The protrusive portion 57A has an approximate shape of a cylindrical rod.

The second locking member 52 includes, a base portion 58 and an engagement portion 59. The base portion 58 extends in a shape of a bar and inclines to be lower toward the rear and higher toward the front. The base portion 58 has a hole 58A at an upper position. The hole 58A is bored through the base portion 58 in the widthwise direction. The engagement portion 59 is arranged at a lower end of the base portion 58 and has teeth 59A at a lower end thereof.

<Rotary Disks 43, 48>

As shown in FIG. 7, the rotary disk 43 has a shape of a disk. A plane disk surface of the rotary disk 43 spreads orthogonally to the widthwise direction. The rotary disk 43 is arranged rightward with respect to the base portion 55 of the first locking member 51. Between the rotary disk 43 and the base portion 41A in the supporting part 41, interposed is the base portion 55 of the first locking member 51. At a center of the rotary disk 43, formed is a hole 43A, through which the screw 44 is inserted. As shown in FIG. 2, the rotary disk 43 may contact a leftward end of the roll M at the rightward face thereof, i.e., the contact face 43B, and hold the roll M rotatably. As shown in FIG. 7, a diameter of the rotary disk 43 is substantially the same as a diameter of the base portion 55 of the first locking member 51. As shown in FIG. 5, the rotary disk 48 has a shape of a disk. A plane disk surface of the rotary disk 48 spreads orthogonally to the widthwise direction. The rotary disk 48 may contact a rightward end of the roll M at the leftward face thereof, i.e., the contact face 48B, and hold the roll M rotatably.

<Assembling Procedure>

A procedure to assemble the supporting part 41, the locking member 5 including the first locking member 51 and the second locking member 52, and the rotary disk 43 together will be described below. Meanwhile, a procedure to assemble the supporting part 46, the locking member 6, and the rotary disk 48 together, which is substantially the same as the procedure to assemble the supporting part 41, the locking member 5, and the rotary disk 43 together, will be herein omitted.

As shown in FIG. 9, first, the base portion 58 in the first locking member 52 is inserted upward in the hole 418 formed in the extended portion 41B in the supporting part 41 from a lower side. The oblique inclination of the hole 418 coincides with an extending direction of the base portion 58 in the second locking member 52. The second locking member 52 is supported in the hole 418 movably with respect to the supporting part 41 along the inclination of the hole 418.

Next, as shown in FIG. 7, the first locking member 51 is moved leftward to the supporting part 41 from the right. Meanwhile, the first locking member 51 in a tilted posture with an upper end portion thereof tilting leftward, is moved upper-leftward from a lower-rightward position with respect to the supporting part 41. With this movement, the contact portion 56 enters the hole 416 and is inserted through the hole 417 in the supporting part 41, and the contact portion 56 exits to the left side of the inner lateral face 411 of the supporting part 41. Thereafter, the first locking member 51 is placed in the original posture without tilting. The base portion 55 in the first locking member 51 fits in the hole 416 in the inner lateral face 411 of the supporting part 41. The base portion 55 of the first locking member 51 is placed in proximity to a rightward face of the base portion 41A of the supporting part 41. The contact portion 56 is placed at a position on the side of the supporting part 41 toward the second face P12. Meanwhile, as shown in FIG. 9, the protrusive portion 57A (see FIG. 7) or the coupling portion 57 is inserted leftward in the hole 419 formed in the extended portion 41B in the supporting part 41 from the right. Further, the protrusive portion 57A (see FIG. 7) is inserted leftward in the hole 58A (see FIG. 7) in the base portion 58 of the second locking member 52 from the right. Thereby, the coupling portion 57 in the first locking member 51 are coupled with the second locking member 52. Meanwhile, an urging member 45 is interposed between the base portion 41A of the supporting part 41 and the base portion 55 of the first locking member 51. The urging member 45 may be a compressive coil spring.

Next, the rotary disk 43 is placed in proximity to a rightward face of the base portion 55 of the first locking member 51 (see FIG. 7) so that the base portion 55 is interposed between the base portion 41A of the supporting part 41 and the rotary disk 43 along the widthwise direction. The rotary disk 43 is arranged at a position on the side of the supporting part 41 toward the first face P11, and the contact face 43B of the rotary disk 43 aligns on the same plane as the inner lateral face 411 of the supporting part 41 to form the first face P11. However, the contact face 43B of the rotary disk 43 may be located rightward with respect to the inner lateral face 411 of the supporting part 41 for a small extent, e.g., 0.2 mm, to be closer to the supporting part 46 than the inner lateral face 411. Similarly, the contact face 48B of the rotary disk 48 may be located leftward with respect to the inner lateral face 461 of the supporting part 46 for a small extent. If the contact faces 43B, 48B are located rightward and leftward with respect to the inner lateral faces 411, 461, respectively, when a roll M having a diameter larger than a diameter of the rotary disks 43, 48 is loaded, widthwise ends of the roll M may not contact the inner lateral face 411 of the supporting part 41 or the inner lateral face 461 of the supporting part 46 but may contact the contact faces 43B of the rotary disk 43 and the contact face 48B of the rotary disk 48 alone so that the roll M may rotate more smoothly without causing friction with the inner lateral faces 411, 461.

Next, the screw 44 is inserted leftward in the hole 43A (see FIG. 7) at the center of the rotary disk 43 from the right. The screw 44 in the hole 55A (see FIG. 7) penetrates the base portion 55 of the first locking member 51 to be screwed to the base portion 41A in the first supporting part 41. The first locking member 51 and the rotary disk 43 is supported by the outer lateral face 412 of the supporting part 41 swingably and rotatably, respectively, about the supporting axis 44C, which coincides with the axis of the rod in the screw 44. In other words, the first locking member 51 and the rotary disk 43 are supported by the supporting part 41 swingably and rotatably, respectively, individually from each other. Together with the swing motion of the first locking member 51, the coupling portion 57 may swing. Moreover, the second locking member 52 coupled with the first locking member 51 through the coupling portion 57 may move in conjunction with the swing motion of the first locking member 51.

Meanwhile, the urging member 45 urges the first locking member 51 in a direction to swing clockwise in a view from the right (see FIG. 9). In the following paragraphs, unless otherwise noted, expression concerning rotating directions (e.g., clockwise or counterclockwise) will be based on the view from the right.

<Opening/Closing Movement of the Cover 3>

In the following paragraphs, described will be behaviors of the locking member 5 when the cover 3 is opened or closed. Meanwhile, the locking member 6, although detailed description thereof is omitted, should behave in the same manner as the locking member 5. FIGS. 10A-10B illustrate the locking member 5 when the cover 3 is at the open position. FIGS. 11A-11B illustrate the locking member 5 when the cover 3 is at the closed position.

Under the condition where the cover 3 is at the open position, as shown in FIGS. 10A-10B, the cover 3 is separated from the opposing face 413 of the supporting part 41. As shown in FIG. 10B, the first locking member 51 may swing clockwise in reaction to the urging force of the urging member 45 (see FIG. 7), as indicated by an arrow Y11. In reaction to the swing motion of the first locking member 51, the coupling portion 57 may move upper-frontward. Further, the base portion 58 of the second locking member 52 coupled with the coupling portion 57 may move upper-frontward, as indicated by an arrow Y12, and the engagement portion 59 of the second locking member 52 may be separated upward from the engaging portion 53 in the fixed part 10B. Meanwhile, the teeth 59A in the engagement portion 59 are unmeshed from the teeth in the engaging portion 53. Therefore, the supporting part 41 may not be restrained from moving in the widthwise direction but may be movable in the widthwise direction. In the following paragraphs, the rotational position of the locking member 5 under the condition where the supporting part 41 is movable in the widthwise direction may be called as an unlocked position.

Meanwhile, as shown in FIG. 10A, under the condition where the cover 3 is at the open position, an upper end of the contact section 56A is located approximately at a vertically same position as the opposing face 413. In other words, the contact section 56A stays within a level of the opposing face 413 without protruding. Meanwhile, the contact section 56A protrudes from the recessed portion 410B, which is formed on the opposing face 413. In the following paragraphs, the position of the contact portion 56, in which the upper end of the contact section 56A is located approximately at the same position as the opposing face 413, will be called as a third position. In this regard, under the condition where the contact portion 56 is located at the third position, the locking member 5 may be maintained at the unlocked position.

The user may, for example, place the cover 3 at the open position and move the supporting parts 41, 46 to separate apart from each other, i.e., outward along the widthwise direction, so that the user may set the roll M (see FIG. 5) at the position between the separated supporting parts 41, 46. After setting the roll M at the position between the separated supporting parts 41, 46, when the user releases the supporting parts 41, 46, the supporting parts 41, 46 may move closer to each other, i.e., inward along the widthwise direction, due to the urging force of the contracting spring 75 in the adjustor 7 so that the distance between the rotary disks 43, 48 may be equal to the width of the roll M. Meanwhile, the contact face 43B, 48B of the rotary disks 43, 48 may contact the widthwise ends of the roll M. The user may thereafter move the cover 3 to close.

In a process where the cover 3 is moved from the open position to the closed position (see FIGS. 11A-11B), the protrusive portion 34 may contact the contact section 56A in the contact portion 56 from the upper side. As the cover 3 is being closed toward the closed position, the protrusive portion 34 may push the contact portion 56 downward and enter the recessed portion 410B formed on the opposing face 413 in the supporting part 41 from the upper side. Meanwhile, the first locking member 51 may swing counterclockwise against the urging force from the urging member 45 (FIG. 7). In conjunction with the swing motion of the first locking member 51, the coupling portion 57 in the first locking member 51 may move obliquely lower-rearward, and the base portion 58 in second locking member 52 coupled with the coupled portion 57 may move obliquely lower-rearward.

As the contact portion 56 moves to the position, where the upper end of the contact section 56A is lower than the opposing face 413, as shown in FIG. 10C, the teeth 59A in the engagement portion 59 of the second locking member 52 may mesh with the teeth in the engaging portion 53. Thereby, the supporting part 41 may be restricted by the locking member 5 from moving in the widthwise direction. In the following paragraphs, the rotational position of the locking member 5 under the condition where the supporting part 41 is restricted from moving in the widthwise direction may be called as a locked position. Further, the position of the contact portion 56 under the condition where the locking member 5 shifts from the unlocked position to the locked position, i.e., the position of the contact portion 56 in FIG. 10C, may be called as a second position. In other words, when the contact portion 56 moves from the third position to the second position, the locking member 5 may shift from the unlocked position to the locked position.

As the cover 3 is further moved toward the closed position, as shown in FIG. 11B, the first locking member 51 may further swing counterclockwise, as indicated by an arrow Y21, and the coupled portion 57 may further move obliquely lower-rearward, as indicated by an arrow Y22. Moreover, the base portion 58 in the second locking member 52 coupled with the coupled portion 57 may further move obliquely lower-rearward. The engagement between the teeth 59A in the engagement portion 59 with the teeth in the engaging portion 53 is maintained, and the locking member 5 is maintained at the locked position until the cover 3 is completely placed at the closed position and while the cover 3 is maintained at the closed position. As shown in FIG. 11A, when the cover 3 is at the closed position, the contact portion 56 is located at the position further downward from the third position (see FIG. 10C). Thus, in the process where the cover 3 moves from the open position (see FIGS. 10A-10B) to the closed position (see FIGS. 11A-11B), the locking member 5 may shift from the unlocked position (see FIGS. 10A-10B) to the locked position (see FIGS. 11A-11B).

When the cover 3 is completely placed at the closed position, and while the supporting parts 41, 46 are restricted from moving in the widthwise direction, the contact faces 43B, 48B of the rotary disks 43, 48 are maintained in contact with the widthwise ends of the roll M. Therefore, the roll M may be supported at the widthwise sides by the supporting parts 41, 46 rotatably so that the thermosensitive label may be unrolled from the roll M to allow image printing thereon.

Benefits by the First Embodiment

In the following paragraphs, the mechanisms and/or the benefits related to the supporting part 41, the locking member 5, and the protrusive portion 34 may be substantially equally related to the supporting part 46, the locking member 6, and the protrusive portion 35, respectively.

The printing apparatus 1 has the pair of supporting parts 4, which are movable in the widthwise direction, to fit with the width of the roll M and support the roll M at the widthwise sides. Meanwhile, the locking members 5, 6 are placed in the unlocked position when the cover 3 is at the open position so that the supporting parts 4 may be moved to fit with the width of the roll M in order to load the roll M. On the other hand, when the cover 3 is at the closed position, the locking members 5, 6 are placed at the locked position so that the roll M may be steadily held in the container compartment 24 while images are being printed on the roll M. The protrusive portion 34 in the cover 3 may contact the locking member 5, and the locking member 5 pushed by the protrusive portion 34 may shift from the unlocked position to the locked position. Meanwhile, the contact portion 56 is placed at the position, where the contact portion 56 does not protrude from the opposing face 413 of the supporting part 41. Moreover, the contact portion 56 is located on the side of the supporting part 41 toward the second face P12 being the side opposite to the first face P11, on which the roll M is arranged. Therefore, the contact portion 56 may be prevented from being unintentionally touched by the user who is loading the roll M in the container compartment 24, and the locking member 5 may be prevented from being moved to the locked position. In this regard, the locking member 6 may behave in the same manner. In other words, the condition, in which the pair of supporting parts 4 are movable, may be secured when the cover 3 is open. Therefore, the user may move the pair of supporting parts 4 in the widthwise direction easily to load the roll M.

The printing apparatus 1 has the urging member 45, which may urge the locking member 5 in the direction to move from the locked position toward the unlocked position. Therefore, while the cover 3 shifts from the closed position to the open position, the urging member 45 may move the locking member 5 from the locked position to the unlocked position. When the locking member 5 is at the unlocked position, meanwhile, the engagement portion 59 in the second locking member 52 is separated from the engaging portion 53. The locking member 6 behaves in the same manner. Therefore, the user may release the pair of supporting parts 4 from the lock to be movable as easily as by opening the cover 3 and may exchange the roll M in the container compartment 24 with another roll M.

The printing apparatus 1 may cause the protrusive portion 34 in the cover 3 to contact the contact portion 56 of the first locking member 51 in the process where the cover 3 is being moved to the closed position. When the first locking member 51 is moved by the cover 3 contacting the contact portion 56 to swing, the second locking member 52 may be moved to swing in conjunction with the swing motion of the first locking member 51 so that the engagement portion 59 may engage with the engaging portion 53. The locking member 6 should behave in the same manner. Thus, through the behaviors of the first locking members 51, 61 and the second locking members 52, 62, the locking members 5, 6 may shift between the unlocked position and the locked position in reaction to the cover 3 being opened and closed.

The contact portion 56 has the contact section 56A, which is resiliently deformable. Therefore, while positions of the cover 3 to press the protrusive portions 34, 35, in particular, vertical positions of the lower ends of the protrusive portions 34, 35 of the cover 3 placed at the closed position, may vary depending on, for example, assembling errors or allowances in the printing apparatus 1, the contact section 56A may resiliently absorb the errors or the allowances so that the amount for the contact section 56A to move downward may be substantially maintained. Furthermore, when, for example, an external shock is caused to the cover 3 at the closed position, the contact section 56A may absorb or reduce the shock and restrain the shock from being transmitted to the locking member 5 through the contact portion 56. Therefore, the locking member 5 may be prevented from being damaged. The locking member 6 should behave in the same manner.

The supporting part 41 has the recessed portion 410B on the opposing face 413. Under the condition where the locking member 5 is at the unlocked position, the contact portion 56 does not protrude to be higher than the opposing face 413 but protrudes from the recessed portion 410B. Therefore, the printing apparatus 1 may cause the protrusive portion 34 to correctly contact the contact portion 56, which protrudes from the recessed portion 410B, to press the contact portion 56 when the cover 3 is being closed. Moreover, while the recessed portion 410B is recessed downward from the opposing face 413, an accidental contact by the user on the contact portion 56 while the roll M is being loaded may be prevented. The supporting part 46, the locking member 6, and the protrusive portion 35 should behave in the same manner.

The supporting part 41 has the finger-hooking portion 410A on the first face P11 at the position higher than the contact face 43B of the rotary disk 43. The supporting part 46 has the finger-hooking portion 460A on the first face P21 at the position higher than the contact face 48B of the rotary disk 48. The finger-hooking portions 410A, 460A may each include two (2) grooves, on which the user's finger may be hooked. Therefore, when the user attempts to move the supporting parts 4 with his/her fingers hooked on the finger-hooking portions 410A, 460A, slippage of the fingers on the supporting parts 4 may be prevented. Thus, usability of the printing apparatus 1 in operating the supporting parts 4 may be improved.

The supporting part 41 has the oblique portion 415 to adjoin the inner lateral face 411, and the supporting part 41 has the oblique portion 465 to adjoin the inner lateral face 461. The oblique portions 415, 465 incline toward the first faces P11, P21, respectively, which are inward in the widthwise direction. Therefore, for example, the user may urge one of the widthwise ends of the roll M against either the oblique portion 415 or the oblique portion 465 so that the supporting parts 41, 46 may move in the widthwise directions toward the second faces P12, P22 outward, respectively, and the distance between the supporting parts 4 may be enlarged. In this regard, the user may widen the distance between the supporting parts 4 easily without directly moving the supporting parts 41, 46. In other words, the user may widen the distance between the supporting parts 4 either by the fingers hooked on the finger-hooking portions 410A, 460A or by urging the widthwise end of the roll M against the oblique portion 415 or the oblique portion 465. Thus, usability of the printing apparatus 1 in operating the supporting parts 4 may be improved.

The rear portion 83 of the side board 8A in the frame 8 is arranged between the extending portions 28B, 28D of the rib 28. With the part of the rear portion 83 being interposed between the extending portions 28B, 28D, if, for example, the printing apparatus 1 falls from a higher position on a floor, and, if a rightward-front corner of the printing apparatus 1 hits the floor, the body 2 may be restrained from being deformed by the impact of the fall, and displacement between the bottom case 2A and the front hood 2B may be restrained in the reasons described in the following paragraphs.

FIGS. 12A-12B are illustrative cross-sectional views of the bottom wall 27A, and the extending portions 28B, 28D viewed from the front, with the protrusive portion 281 being omitted. In particular, FIG. 12A illustrates an arrangement of the bottom wall 27A and the extending portions 28B, 28D, in a case where the side board 8A is not located between the extending portions 28B, 28D. In a situation such that a rightward force caused by the impact of the fall is applied to the body 2 of the printing apparatus 1, the extending portions 28B, 28D may deform rightward. In particular, a deformation amount D21 at areas of the extending portions 28B, 28D farther from the bottom wall 28A may be greater than a deformation amount D1 at areas of the extending portions 28B, 28D closer to the bottom wall 28A, because in the farther areas the deformation amount may be magnified. Meanwhile, the extending portion 28B is connected to the side wall 28B through the extending portions 28A, 28C. In this regard, in the areas that are farther from the bottom wall 27A, the bottom case 2A and the front hood 2B may be displaced from each other by the impact of the fall.

On the other hand, FIG. 12B illustrates an arrangement of the bottom wall 27A and the extending portions 28B, 28D, with the side board 8A being placed between the extending portions 28B, 28D. In a situation such that the rightward force caused by the impact of the fall is applied to the body 2 of the printing apparatus 1, the extending portions 28B, 28D may deform rightward and contact the side board 8A at the areas closer to the bottom wall 27A and at the areas farther from the bottom wall 27A. Meanwhile, as mentioned earlier, the frame 8 including the side board 8A is more rigid than the body 2. Therefore, the deformation at the areas of the extending portions 28B, 28D farther from the bottom wall 28A may be restrained from increasing by the contact with the side board 8A. In other words, a deformation amount D22 in the areas of the extending portions 28B, 28D farther from the bottom wall 28A may be smaller than the deformation amount D21 at the areas of the extending portions 28B, 28D farther from the bottom wall 28A without the frame 8 between the extending portions 28B, 28D. Therefore, even with the impact of the fall, displacement between the bottom case 2A and the front hood 2B may be restrained.

With the frame 8 having the side board 8A that extends downward to be interposed between the extending portions 28B, 28D, the printing apparatus 1 may restrain the bottom case 2A and the front hood 2B from being displaced by the impact of the fall.

Modified Example

Although an example of carrying out the invention have been described, those skilled in the art will appreciate that there are numerous variations and permutations of the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, as shown in FIG. 13, when the cover 3 is at the open position, the upper end of the contact section 56A in the contact portion 56 may protrude upward to be higher than the opposing face 413. In the following paragraphs, the position of the contact portion 56, in which the upper end of the contact section 56A protrudes to be higher than the opposing face 413, may be called as a first position.

In a process where the cover 3 is moved from the open position toward the closed position, the protrusive portion 34 may contact the contact portion 56 protruding upward from the opposing face 413 and may push the contact portion 56 downward. When the contact portion 56 being pushed downward moves from the first position to the third position, in which the upper end of the contact section 56A is located approximately at the same position as the opposing face 413, the locking member 5 may be maintained at the unlocked position. As the cover 3 moves further downward, the contact portion 56 may move downward from the third position to the second position. When the contact portion 56 reaches the second position, the locking member 5 may shift from the unlocked position to the locked position. When the cover 3 moves further downward to the closed position, the contact portion 56 may be located at a further downward position with respect to the third position, and the locking member 5 may be maintained at the locked position.

Benefits by the Modified Example

According to the modified example, the contact portion 56 may protrude from the opposing face 413 when the cover 3 is at the open position. As the cover 3 is moved to the closed position, the printing apparatus 1 may cause the protrusive portion 34 to contact the contact portion 56 correctly to push the contact portion 56. The locking member 6 should behave in the same manner. Therefore, the printing apparatus 1 may cause the locking members 5, 6 to shift from the unlocked position to the locked position.

While the contact portion 56 moves from the first position to the third position, the locking member 5, 6 may be maintained at the unlocked position. Moreover, in reaction to the contact portion 56 moving from the third position to the second position, the locking members 5, 6 may shift from the unlocked position to the locked position. Therefore, if, for example, the user contacts the contact portion 56, and the contact section 56A moves to the position, where the upper end of the contact section 56A aligns at the same vertical position with the opposing face 413, the locking members 5, 6 may be maintained at the unlocked position. In this regard, the printing apparatus 1 may prevent the locking members 5, 6 from moving to the locked position contrarily to the user's intention.

More Examples

For another example, both of the pair of supporting parts 4 may not necessarily be movable in the widthwise direction, but solely one of the pair of supporting parts 4 may be movable in the widthwise direction. That is, for example, while the supporting part 41 may be movable in the widthwise direction, the supporting part 46 may be fixed immovably to the container compartment 24. In this configuration, solely the one of the supporting parts 4 that is movable, e.g., the supporting part 41, may have the locking member 5, and the other one of the supporting parts 4 that is not movable, e.g., the supporting part 46, may not be equipped with the locking member 6. For another example, the engaging portions 53, 54 may be arranged on an inward face of the body 2.

For another example, the first locking member 51 may not necessarily be urged by the urging member 45 but may swing clockwise from the locked position to the unlocked position due to the effect of gravity by a weight thereof while the cover 3 moves from the closed position to the open position. In other words, the urging member 45 may be omitted.

For another example, the first locking member 51 and the second locking member 52 may be unified to form the locking member 5. For example, the second locking member 52 and the engagement portion 59 may be directly connected to the tip end of the coupling portion 57 in the first locking member 51. Alternately, the locking member 5 may solely have a contact portion, which is vertically movable, and an engagement portion arranged at a lower end of the contact portion. In this alternate configuration, the protrusive portions 34, 35 may push the contact portion downward in conjunction with the cover 3 being closed, and the engagement portion may engage with the engaging portions 53, 54. For another example, the form of the contact section 56A in the contact portion 56 may not necessarily be limited to that illustrated above. For another example, the contact section 56A may be formed in a resiliently deformable material, such as rubber. For another example, the contact portion 56 may not necessarily have the contact section 56A. For another example, the opposing face 413 may not necessarily have the recessed portion 410B. Meanwhile, the contact portion 56 is arranged on the side of the supporting part 41 toward the second face P12, and the inner lateral face 411 is arranged on the side of the supporting part 41 toward the first face P11, opposite to the contact portion 56 in the widthwise direction. In this regard, when the roll M is loaded, the roll M and/or the user's finger may contact the inner lateral face 411 before contacting the contact portion 56. Therefore, even if the recessed portion 410B is omitted from the opposing face 413, the inner lateral face 411 may prevent the roll M and the user's finger from contacting the contact portion 56. The supporting part 46 should have the same benefit as well.

The shapes of the finger-hooking portions 410A, 460A in the supporting parts 41, 46 may not necessarily be limited to those described above. For example, the finger-hooking portions 410A, 460A may be a plurality of round dimples formed in the inner lateral faces 411, 461. For another example, pieces of anti-slipping material, e.g., a material with a larger friction coefficient such as rubber, may be attached on the inner lateral faces 411, 461.

What is claimed is:

1. A printing apparatus, comprising:

a body comprising a container compartment, the container compartment being configured to store a roll including a rolled recording medium, the roll being stored in the container compartment with a width thereof aligning with a first direction, the container compartment being open toward one side of the body in a second direction, the second direction being orthogonal to the first direction;

a cover configured to be closable to cover an opening of the container compartment and openable to uncover the opening of the container compartment;

a pair of supporting parts arranged in the container compartment and configured to support sides of the roll along the first direction, at least one of the pair of supporting parts being a movable supporting part configured to be movable in the first direction;

a locking member arranged on the movable supporting part, the locking member being movable between a locked position, in which the locking member restricts the movable supporting part from moving under a condition where the cover is closed, and an unlocked position, in which the locking member allows the movable supporting part to move under a condition where the cover is open; and an engaging portion arranged in the container compartment and configured to engage with the locking member being located at the locked position, wherein the movable supporting part comprises an opposing face arranged to face the cover under the condition where the cover is closed, the movable supporting part comprising a first face and a second face facing opposite to the first face in the first direction, the first face including a contact face, the contact face being configured to contact one of the sides of the roll in the first direction;

wherein the locking member comprises a contact portion at a position where the contact portion does not protrude from the opposing face, on a side of the movable supporting part toward the second face;

wherein the cover comprises a protrusive portion configured to contact the contact portion;

wherein the locking member at the unlocked position, under the condition where the cover is open, is separated from the engaging portion; and wherein, in a process where the cover being open is moved to be closed, the protrusive portion of the cover is configured to contact to be pressed against the contact portion of the locking member, causing the locking member to shift from the unlocked position to the locked position to be engaged with the engaging portion.

2. The printing apparatus according to claim 1, further comprising an urging member configured to urge the locking member in a direction from the locked position toward the unlocked position.

3. The printing apparatus according to claim 1, wherein the locking member comprises:

a first locking member comprising the contact portion, the first locking member being swingably supported by a lateral face of the movable supporting part to swing about a supporting shaft; and a second locking member movably supported by the movable supporting part, the second locking member being configured to move in conjunction with a swing motion of the first locking member, the second locking member including an engagement portion engageable with the engaging portion.

4. The printing apparatus according to claim 1, wherein the contact portion comprises a resiliently deformable contact section.

5. The printing apparatus according to claim 1, wherein the movable supporting part comprises a recessed portion on the opposing face, the recessed portion being deepened in a direction opposite to the cover under the condition where the cover is closed; and wherein the contact portion is arranged not to protrude from the opposing face of the movable supporting part but to protrude from the recessed portion.

6. The printing apparatus according to claim 1, wherein the movable supporting part comprises a finger-hooking portion on the first face at a position closer to the one side of the body than the contact face in the second direction.

7. The printing apparatus according to claim 1, wherein the movable supporting part comprises an oblique portion on the side toward the first face at a position closer to the one side of the body than the contact face in the second direction, the oblique portion inclining with respect to the contact face; and wherein the oblique portion inclines toward the first face as the oblique portion extends from one end toward the other end in an orientation from the one side toward the other side of the body in the second direction.

8. A printing apparatus, comprising:

a body comprising a container compartment, the container compartment being configured to store a roll including a rolled recording medium, the roll being stored in the container compartment with a width thereof aligning with a first direction, the container compartment being open toward one side of the body in a second direction, the second direction being orthogonal to the first direction;

a cover configured to be closable to cover an opening of the container compartment and openable to uncover the opening of the container compartment;

a pair of supporting parts arranged in the container compartment and configured to support sides of the roll along the first direction, at least one of the pair of supporting parts being a movable supporting part configured to be movable in the first direction;

a locking member arranged on the movable supporting part, the locking member being movable between a locked position, in which the locking member restricts the movable supporting part from moving under a condition where the cover is closed, and an unlocked position, in which the locking member allows the movable supporting part to move under a condition where the cover is open; and an engaging portion arranged in the container compartment and configured to engage with the locking member being located at the locked position, wherein the movable supporting part comprises an opposing face arranged to face the cover under the condition where the cover is closed, the movable supporting part comprising a first face and a second face facing opposite to the first face in the first direction, the first face including a contact face, the contact face being configured to contact one of the sides of the roll in the first direction;

wherein the locking member comprises a contact portion at a first position where the contact portion protrudes from the opposing face, on a side of the movable supporting part, toward the second face;

wherein the cover comprises a protrusive portion configured to contact the contact portion;

wherein the locking member at the unlocked position under the condition where the cover is open, is separated from the engaging portion; and wherein, in a process where the cover being open is moved to be closed, the protrusive portion of the cover is configured to contact and to be pressed against the contact portion of the locking member and move the contact portion from the first position to a second position, the second position being on a side opposite to the first position from the opposing face in the second direction, causing the locking member to shift from the unlocked position to the locked position to be engaged with the engaging portion.

9. The printing apparatus according to claim 8, wherein, under a condition where the contact portion moves from the first position to a third position, the third position being at a same height as the opposing face, the locking member is maintained at the unlocked position; and wherein, under a condition where the contact portion moves from the third position to the second position, the locking member shifts from the unlocked position to the locked position.

* * * * *